US009902185B2

(12) United States Patent
Raming

(10) Patent No.: US 9,902,185 B2
(45) Date of Patent: Feb. 27, 2018

(54) AUTO-PEEL LABEL WITH PROJECTING EDGE

(71) Applicant: Premier Print & Services Group, Inc., Chicago, IL (US)

(72) Inventor: Bruce Raming, Northbrook, IL (US)

(73) Assignee: Premier Print & Services Group, Inc., Chicago, IL (US)

( * ) Notice: Subject to any disclaimer, the term of this patent is extended or adjusted under 35 U.S.C. 154(b) by 364 days.

(21) Appl. No.: 14/599,818

(22) Filed: Jan. 19, 2015

(65) Prior Publication Data

US 2015/0128466 A1 May 14, 2015

Related U.S. Application Data

(63) Continuation of application No. 13/661,642, filed on Oct. 26, 2012, now Pat. No. 8,950,783.

(51) Int. Cl.

| | |
|---|---|
| ***B42D 15/00*** | (2006.01) |
| ***G09F 3/00*** | (2006.01) |
| ***G09F 3/10*** | (2006.01) |
| *G09F 3/02* | (2006.01) |

(52) U.S. Cl.

CPC ..... *B42D 15/006* (2013.01); *G09F 3/0288* (2013.01); *G09F 3/0297* (2013.01); *G09F 3/10* (2013.01); *G09F 2003/0229* (2013.01); *Y10T 428/15* (2015.01)

(58) Field of Classification Search

CPC ..... B42D 15/006

USPC ..... 283/60.1, 66.1–66.2, 79, 103; 428/40.1, 428/42.2, 43

See application file for complete search history.

(56) References Cited

U.S. PATENT DOCUMENTS

| | | | | |
|---|---|---|---|---|
| 6,953,207 | B2 * | 10/2005 | Raming | B42D 15/006 283/105 |
| RE39,100 | E * | 5/2006 | Raming | B42D 15/006 283/101 |
| 2010/0156087 | A1 * | 6/2010 | Raming | B65C 9/46 283/81 |
| 2010/0259037 | A1 * | 10/2010 | Hanrahan | B65C 1/02 283/81 |
| 2011/0000809 | A1 * | 1/2011 | D'Amato | B65D 25/205 206/459.5 |

* cited by examiner

*Primary Examiner* — Kyle Grabowski
(74) *Attorney, Agent, or Firm* — Hovey Williams LLP

(57) ABSTRACT

A multiple-ply label roll includes end-to-end labels. Each label is operable to be adhesively applied to a substrate and includes top and bottom label plies. The bottom label ply includes an outer removable border portion defined between interior and outer ply edges and removable from the top label ply in a removal direction. The interior ply edge includes spaced apart side edges that extend along the removal direction to define a pair of spaced apart side sections of the removable portion. The interior ply edge includes a generally transverse end edge interconnecting the side edges to define an end section of the removable portion, with the end section extending between the side sections and being removed generally after the side sections when the removable portion is removed in the removal direction.

26 Claims, 13 Drawing Sheets

AUTO-PEEL LABEL WITH PROJECTING EDGE

RELATED APPLICATION

Figure 1:
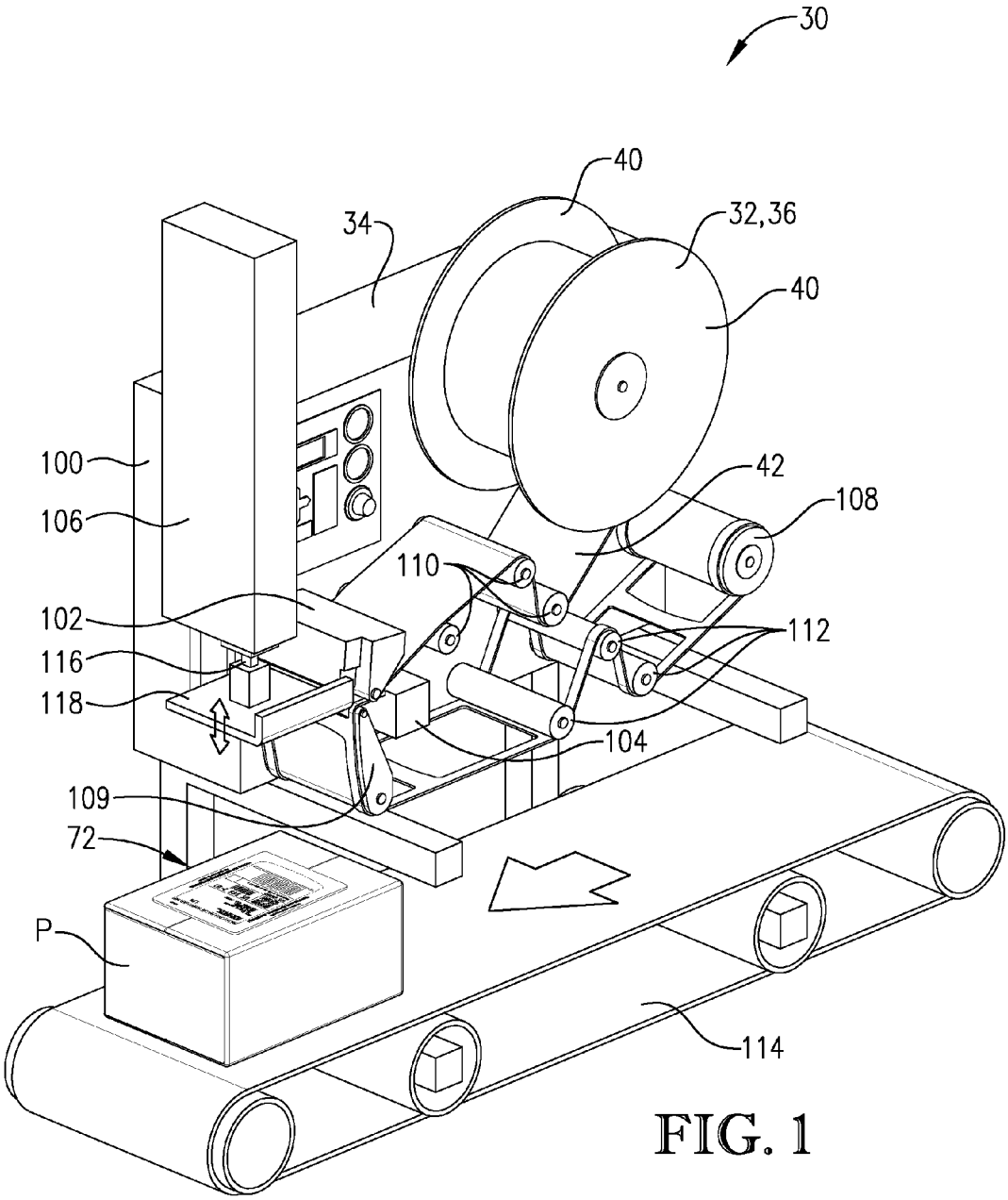

This is a continuation of prior application Ser. No. 13/661,642, filed Oct. 26, 2012, entitled AUTO-PEEL LABEL WITH PROJECTING EDGE, which is hereby incorporated in its entirety by reference herein.

BACKGROUND

1. Field

The present invention relates generally to shipping labels. More specifically, embodiments of the present invention concern an auto-apply shipping label with top and bottom label plies.

2. Discussion of Prior Art

Many types of business forms are designed to be adhesively attached to a substrate, such as a product or a product container. For instance, shipping labels are often adhered directly to a box, envelope, or other packaging for shipping a product. Conventional shipping and packing labels are provided as separate labels for each shipping package, with the packing label normally being held by the shipping label so that the contents indicia printed on the packing label are hidden from view. Some prior art shipping labels have been produced in the form of a duplex printed label with shipping indicia on one side and package contents indicia on the other side. These labels are printed and applied to a package by a conventional duplex print and apply station that automates the printing and application of labels to packages.

Conventional adhesive business forms, including adhesive shipping labels, suffer from various undesirable limitations. Conventional shipping labels are unreliable for use with automated print and apply stations. For conventional labels having a removable liner removably adhered to a label ply, such label construction promotes inconsistent liner removal when the label is fed through an automated print and apply station.

SUMMARY

The following brief summary is provided to indicate the nature of the subject matter disclosed herein. While certain aspects of the present invention are described below, the summary is not intended to limit the scope of the present invention.

Embodiments of the present invention provide a label and a label roll that do not suffer from the problems and limitations of the prior art labels set forth above.

A first aspect of the present invention concerns a label that broadly includes adhesively coupled top and bottom label plies. Each of the label plies includes top and bottom faces and an outer ply edge, with the bottom face of the top label ply and the top face of the bottom label ply being opposed when the label plies are adhesively coupled. The top label ply is operable to be adhesively applied to a substrate. The bottom label ply includes an interior ply edge spaced at least in part from the outer ply edge such that a central window is defined in the bottom label ply. The bottom label ply further includes an outer removable border portion defined between the interior and outer ply edges, with the border portion being removable from the top label ply in a removal direction. The interior ply edge includes a pair of spaced apart side edges that extend along the removal direction to define a pair of spaced apart side sections of the removable portion. The interior ply edge includes a generally transverse end edge extending between the side edges to define an end section of the removable portion, with the end section interconnecting the side sections and being removed generally after the side sections when the removable portion is removed in the removal direction. The end edge is devoid of any straight segment that is at least substantially perpendicular to the removal direction.

A second aspect of the present invention concerns a label roll that broadly includes a multiple-ply wound roll. The multiple-ply wound roll presents a plurality of end-to-end labels. Each of the labels includes adhesively coupled top and bottom label plies. Each of the label plies includes top and bottom faces, with the bottom face of the top label ply and the top face of the bottom label ply being opposed when the label plies are adhesively coupled. The top label ply is operable to be adhesively applied to a substrate. The bottom label ply includes an interior ply edge such that a central window is defined in the bottom label ply. The bottom label ply further includes an outer removable border portion defined outboard of the interior ply edge. The border portion is removable from the top label ply in a removal direction, with the removal direction extending along the length of the roll. The interior ply edge includes a pair of spaced apart side edges that extend along the removal direction to define a pair of spaced apart side sections of the removable portion. The interior ply edge includes a generally transverse end edge extending between the side edges to define an end section of the removable portion, with the end section interconnecting the side sections and being removed generally after the side sections when the removable portion is removed in the removal direction. The end edge is devoid of any straight segment that is at least substantially perpendicular to the removal direction.

A third aspect of the present invention concerns a label that broadly includes adhesively coupled top and bottom label plies. Each of the label plies includes top and bottom faces and an outer ply edge, with the bottom face of the top label ply and the top face of the bottom label ply being opposed when the label plies are adhesively coupled. The top label ply is operable to be adhesively applied to a substrate. The bottom label ply includes an interior ply edge spaced at least in part from the outer ply edge such that a central window is defined in the bottom label ply. The bottom label ply further includes an outer removable border portion defined between the interior and outer ply edges, with the border portion being removable from the top label ply in a removal direction. The interior ply edge includes a pair of spaced apart side edges that extend along the removal direction to define a pair of spaced apart side sections of the removable portion. The interior ply edge includes a generally transverse end edge interconnecting the side edges to define an end section of the removable portion, with the end section extending between the side sections and being removed generally after the side sections when the removable portion is removed in the removal direction. The side edges define a window width adjacent the end edge. The end edge presents a straight segment that is at least substantially perpendicular to the removal direction, with the straight segment presenting a length dimension that is less than about forty percent of the window width.

A fourth aspect of the present invention concerns a label roll that broadly includes a multiple-ply wound roll. The multiple-ply wound roll presents a plurality of end-to-end labels. Each of the labels includes adhesively coupled top and bottom label plies. Each of the label plies includes top and bottom faces, with the bottom face of the top label ply and the top face of the bottom label ply being opposed when the label plies are adhesively coupled. The top label ply is operable to be adhesively applied to a substrate. The bottom label ply includes an interior ply edge such that a central window is defined in the bottom label ply. The bottom label ply further includes an outer removable border portion defined outboard of the interior ply edge. The border portion is removable from the top label ply in a removal direction, with the removal direction extending along the length of the roll. The interior ply edge includes a pair of spaced apart side edges that extend along the removal direction to define a pair of spaced apart side sections of the removable portion. The interior ply edge includes a generally transverse end edge extending between the side edges to define an end section of the removable portion, with the end section interconnecting the side sections and being removed generally after the side sections when the removable portion is removed in the removal direction. The side edges define a window width adjacent the end edge. The end edge presents a straight segment that is at least substantially perpendicular to the removal direction, with the straight segment presenting a length dimension that is less than about forty percent of the window width.

Other aspects and advantages of the present invention will be apparent from the following detailed description of the preferred embodiments and the accompanying drawing figures.

BRIEF DESCRIPTION OF THE DRAWING FIGURES

Figure 2:
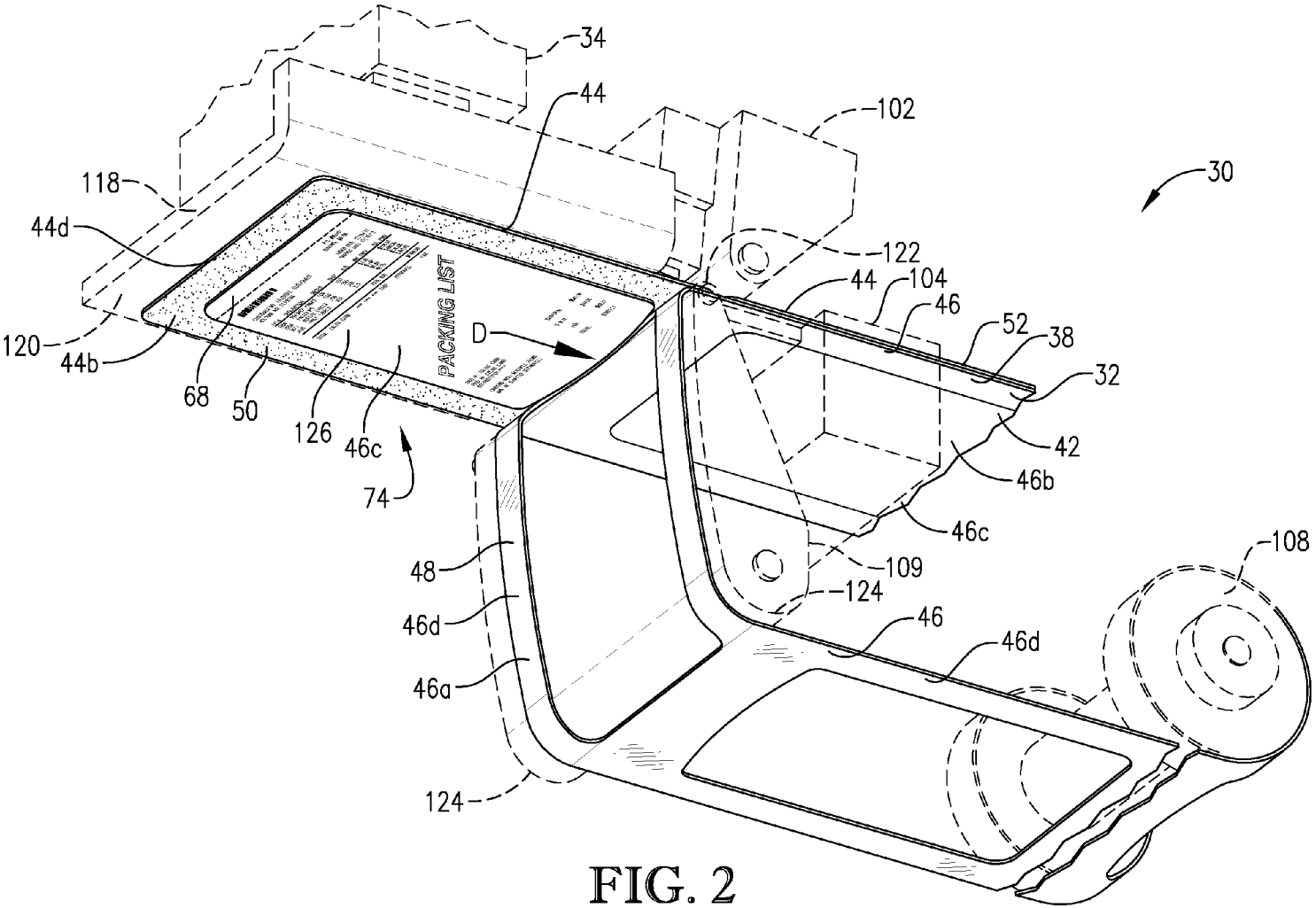
Figure 3:
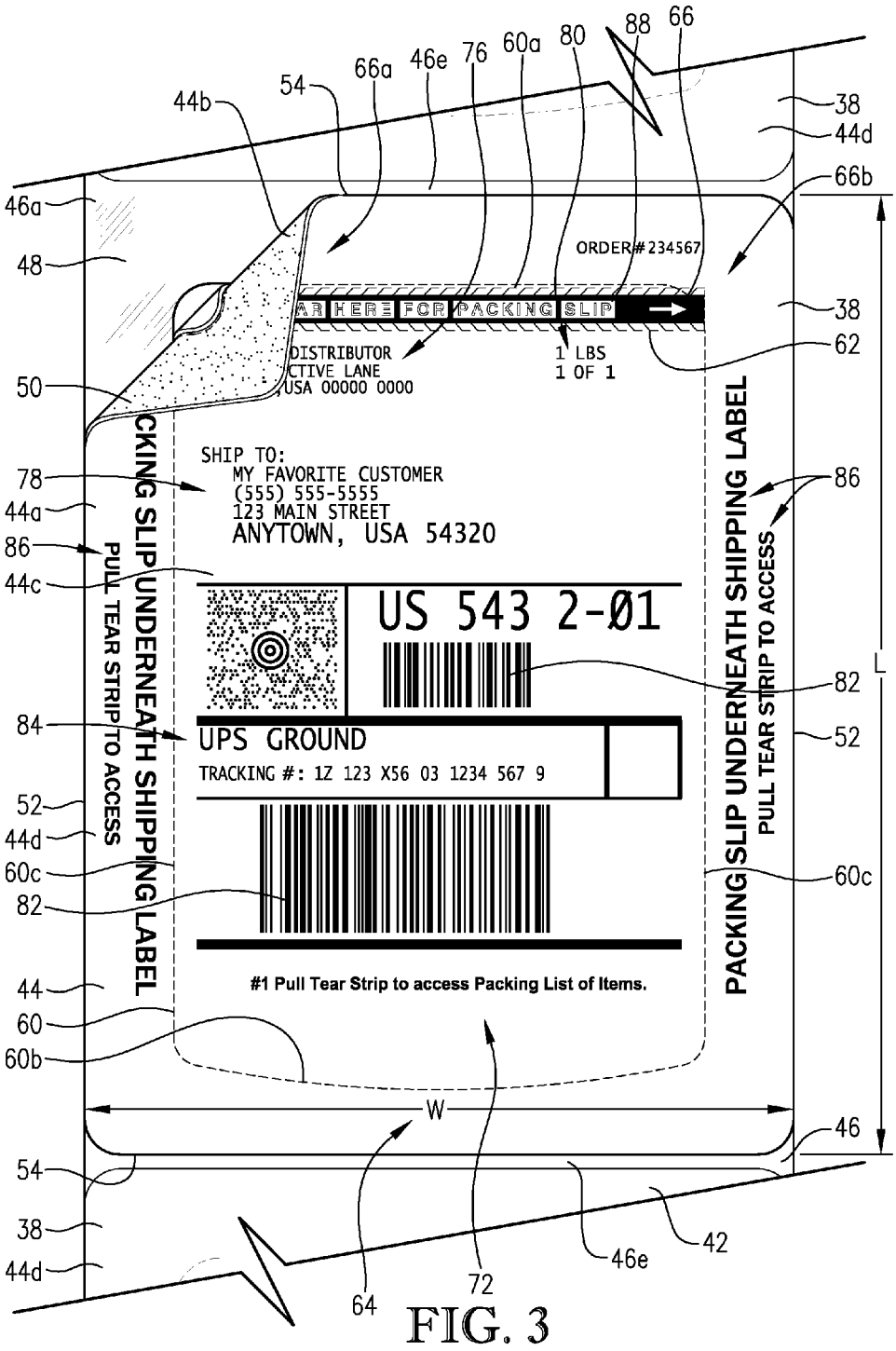
Figure 4:
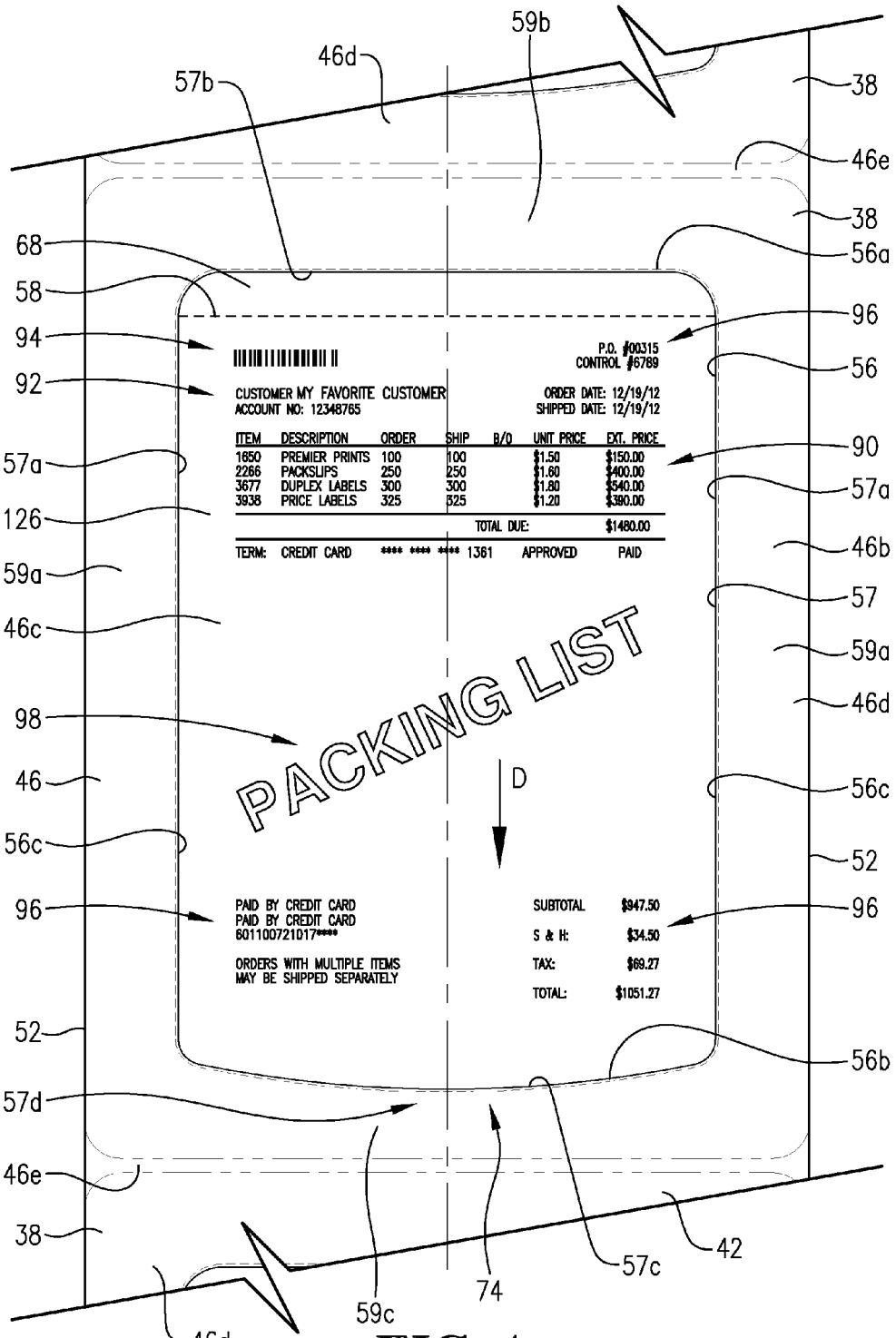
Figure 5:
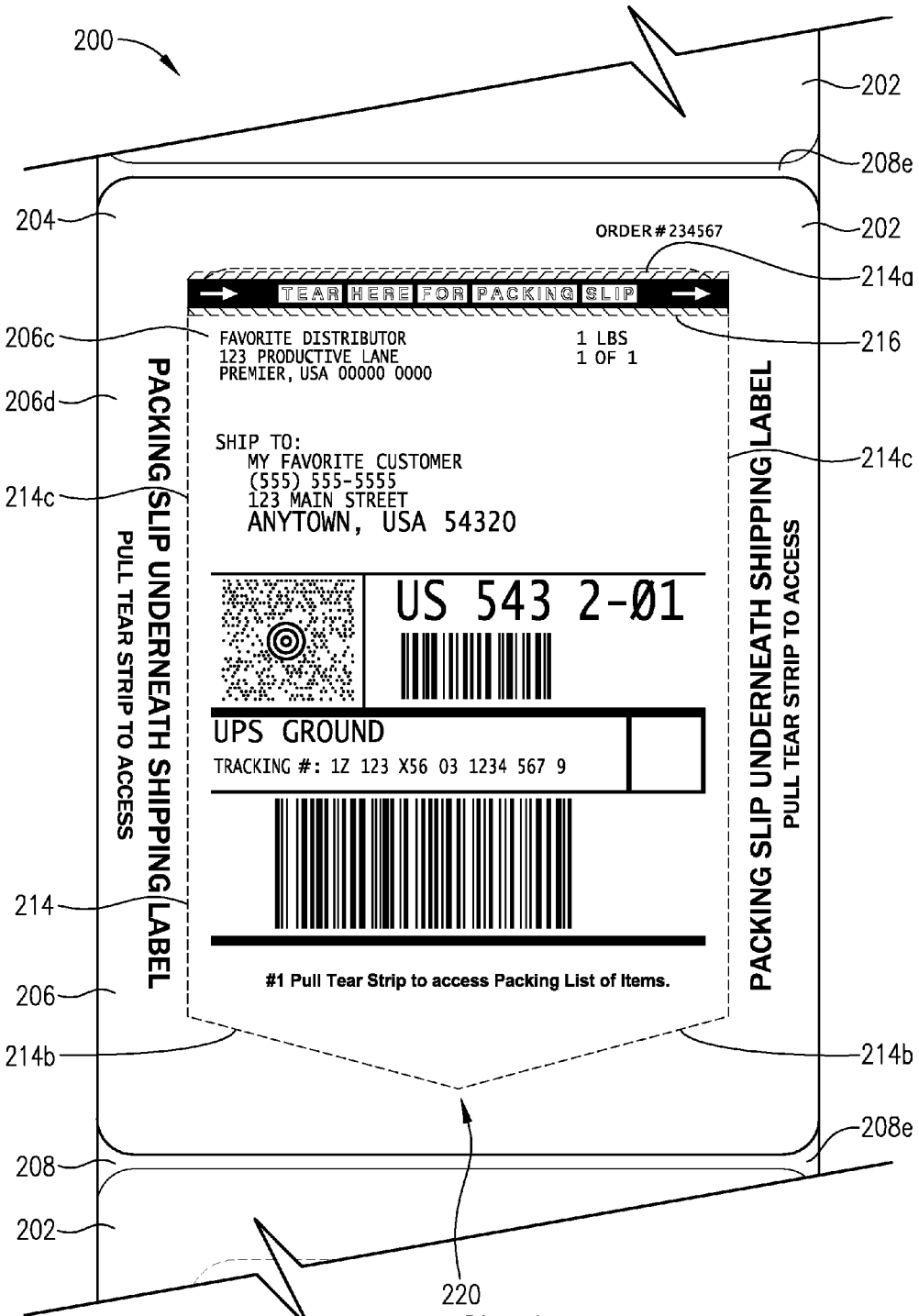
Figure 6:
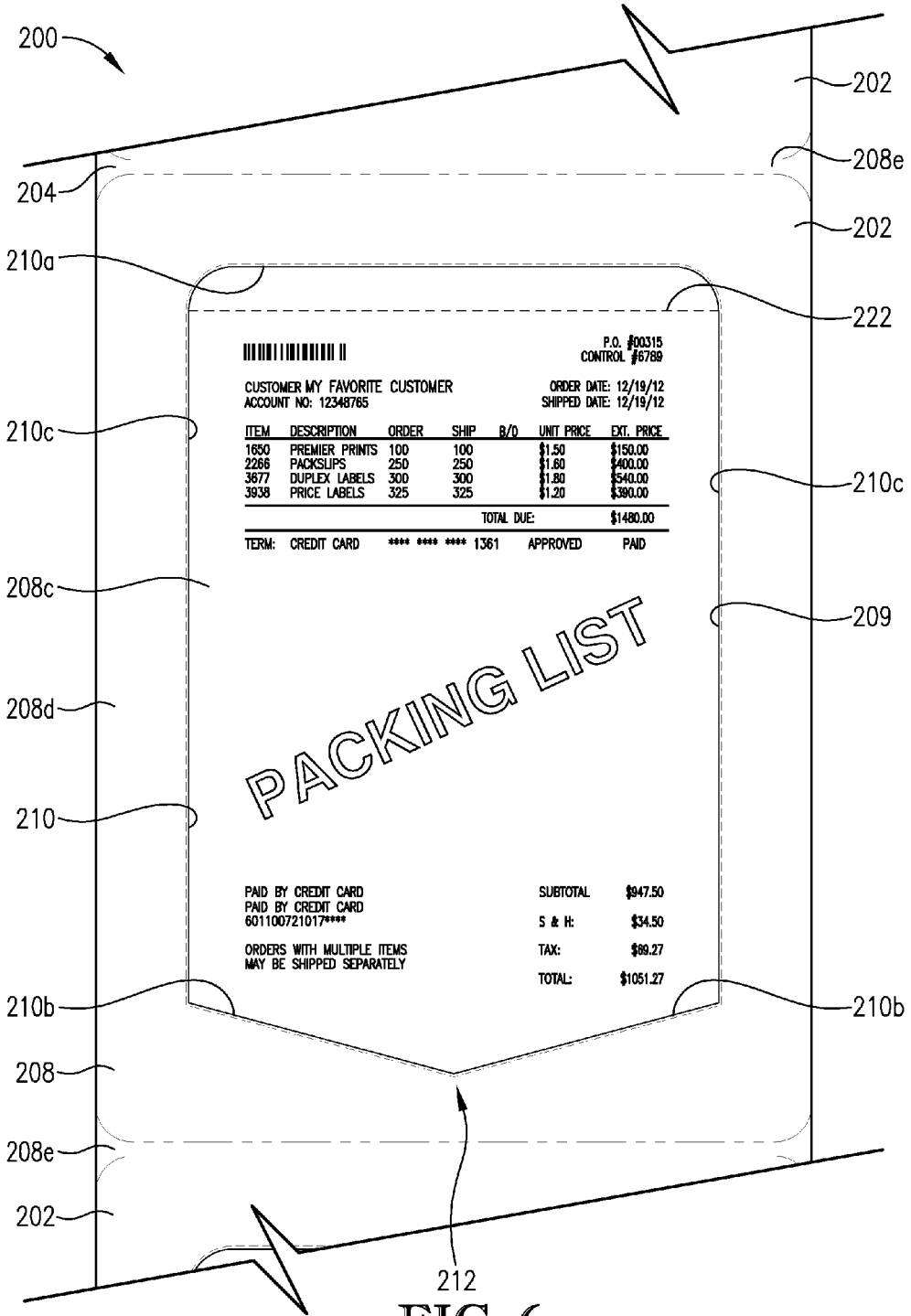
Figure 7:
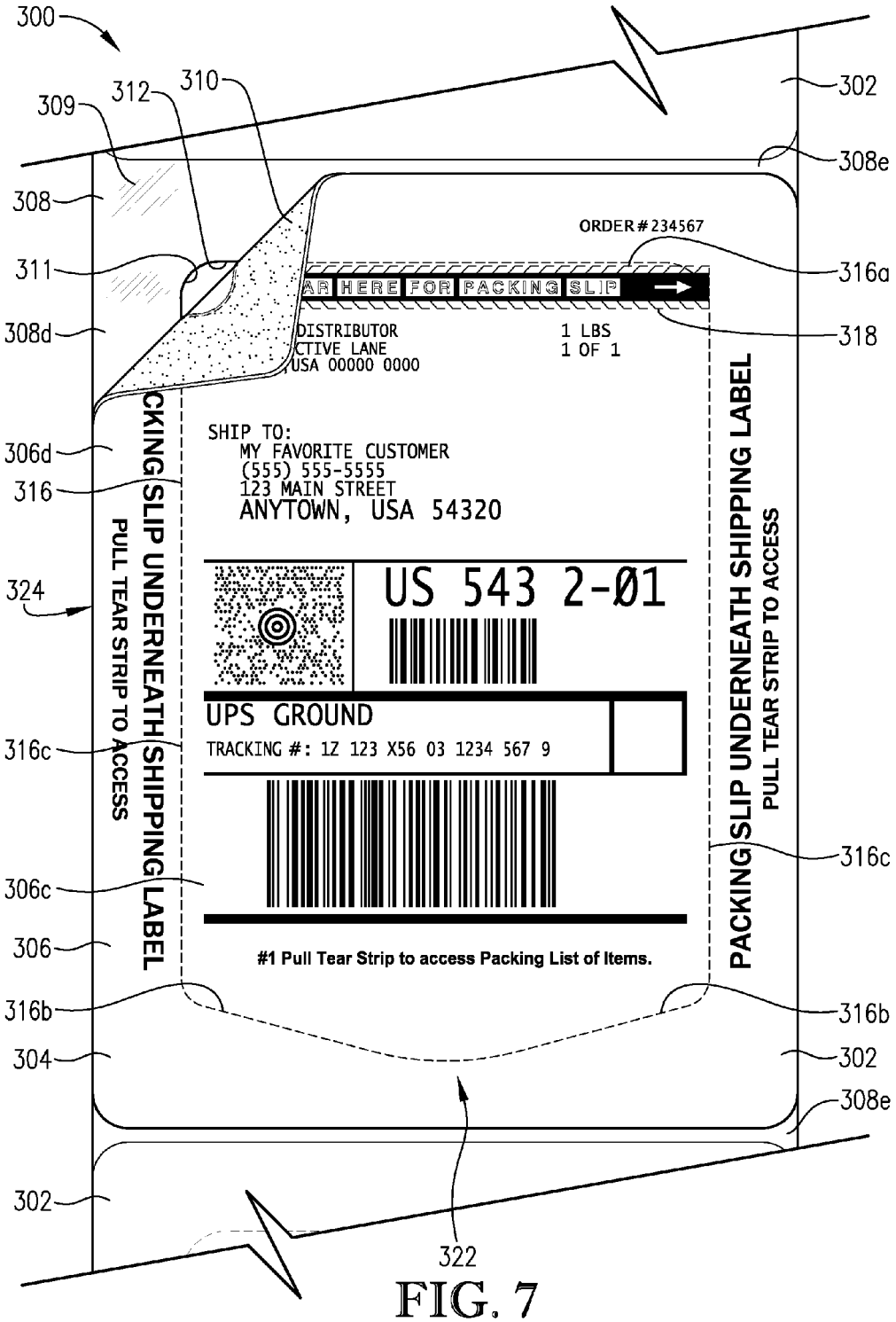
Figure 8:
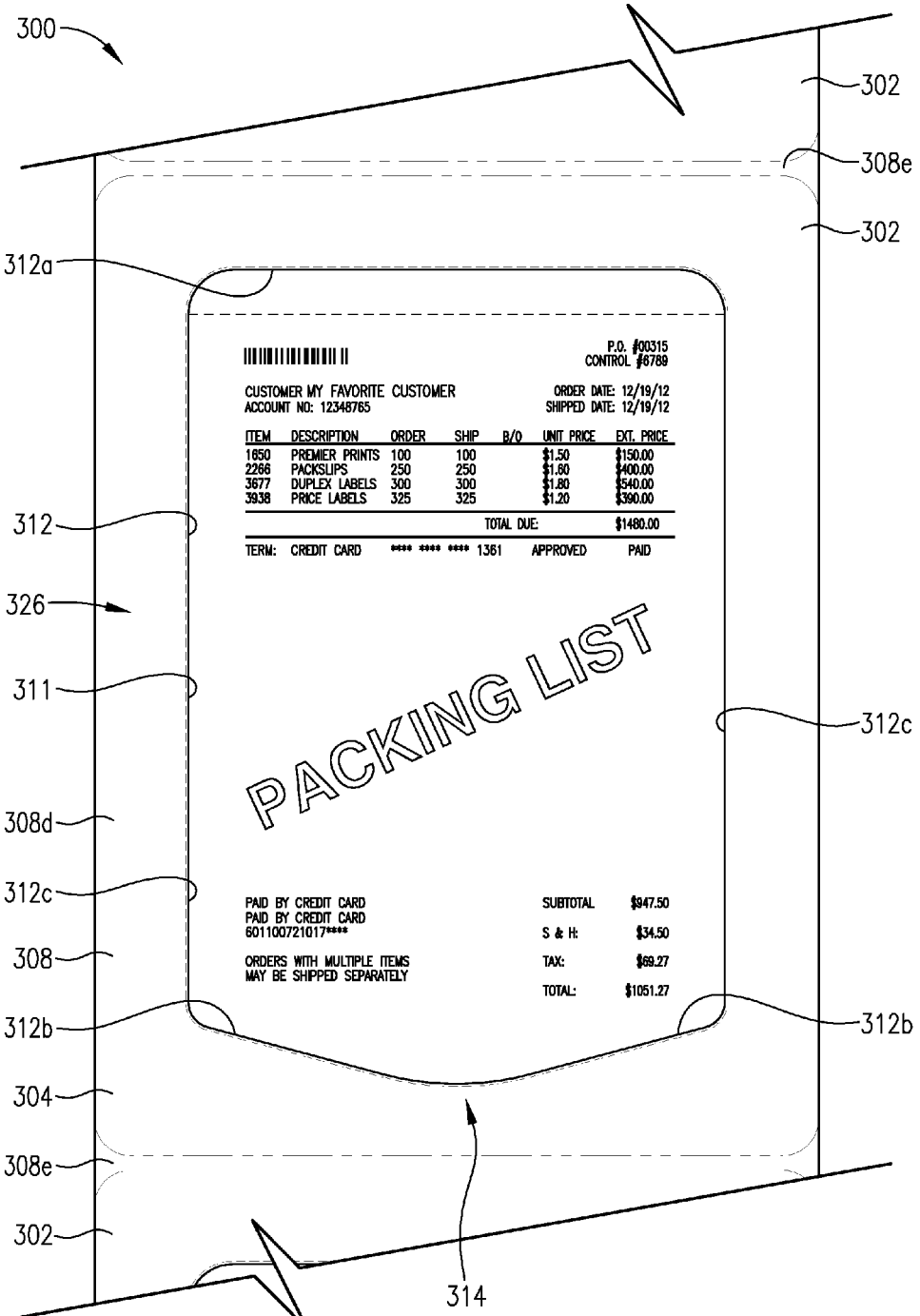
Figure 9:
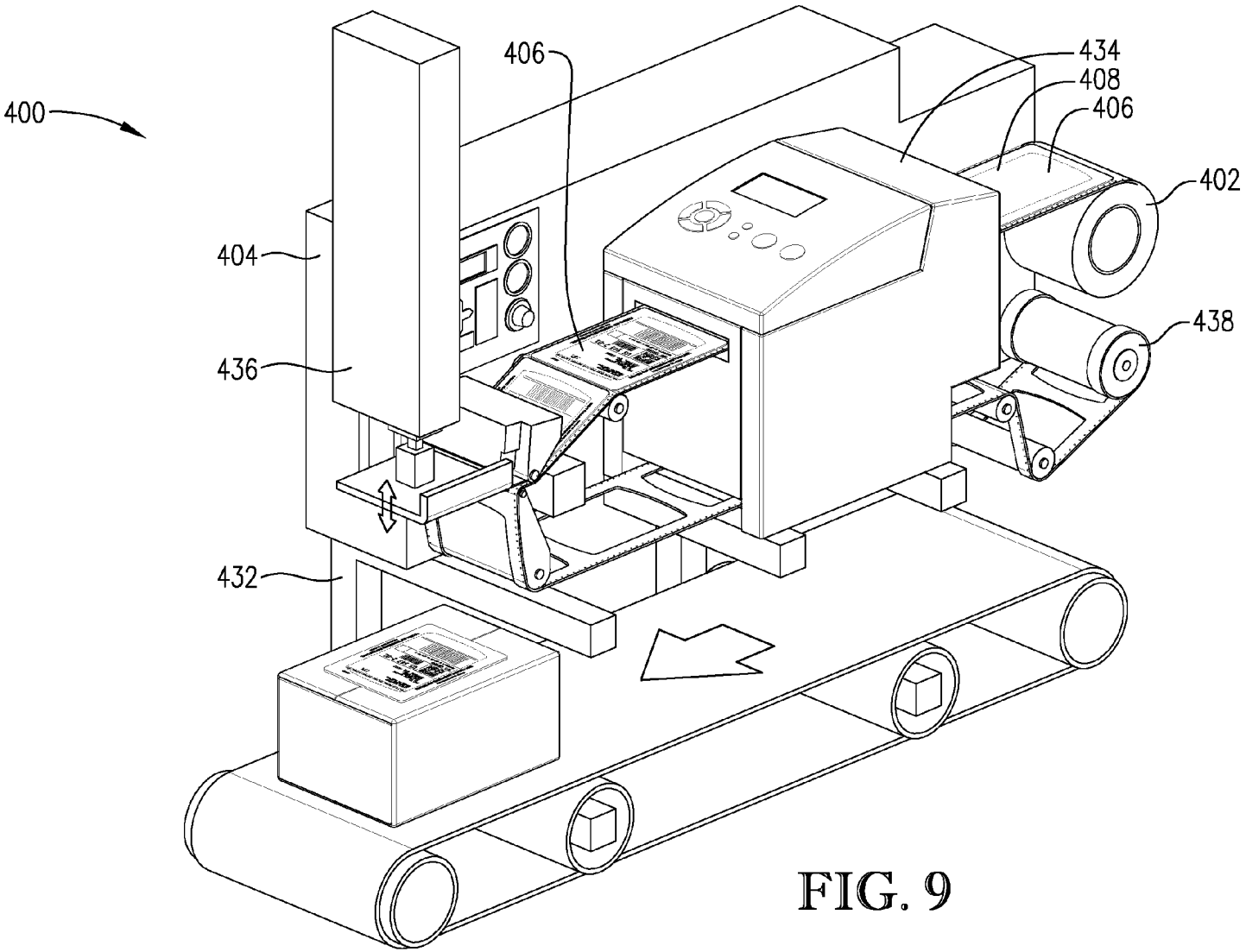
Figure 10:
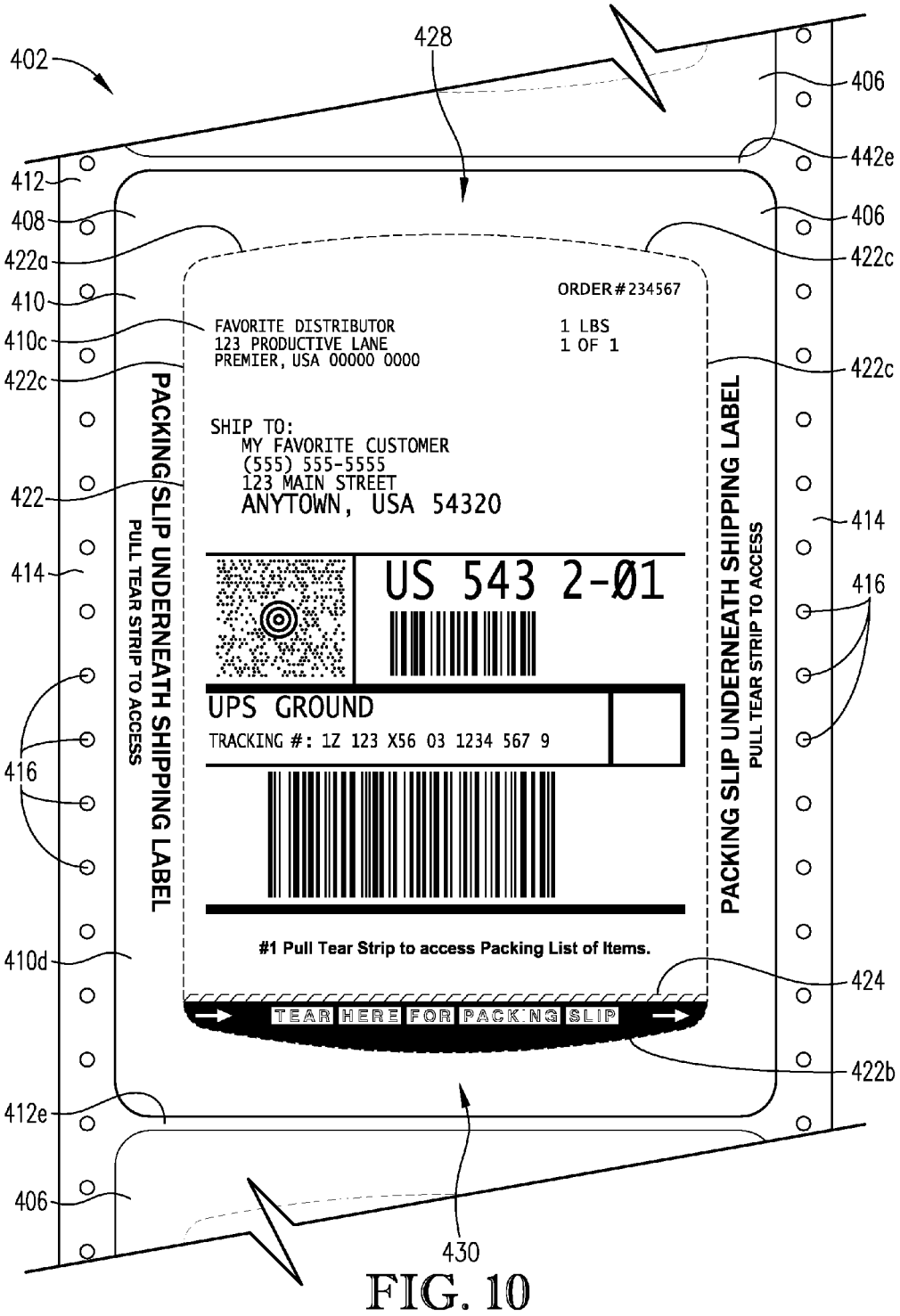
Figure 11:
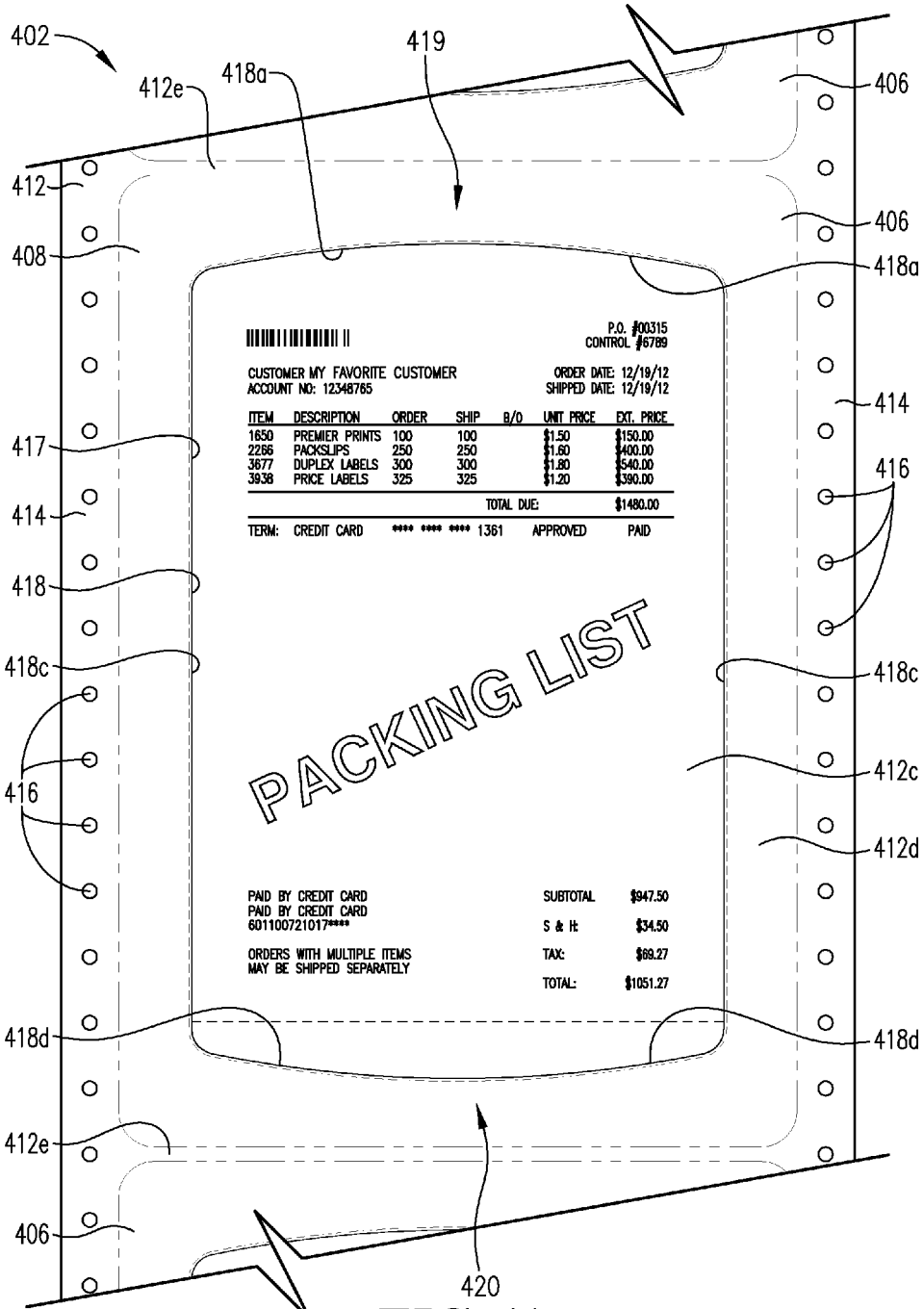
Figure 12:
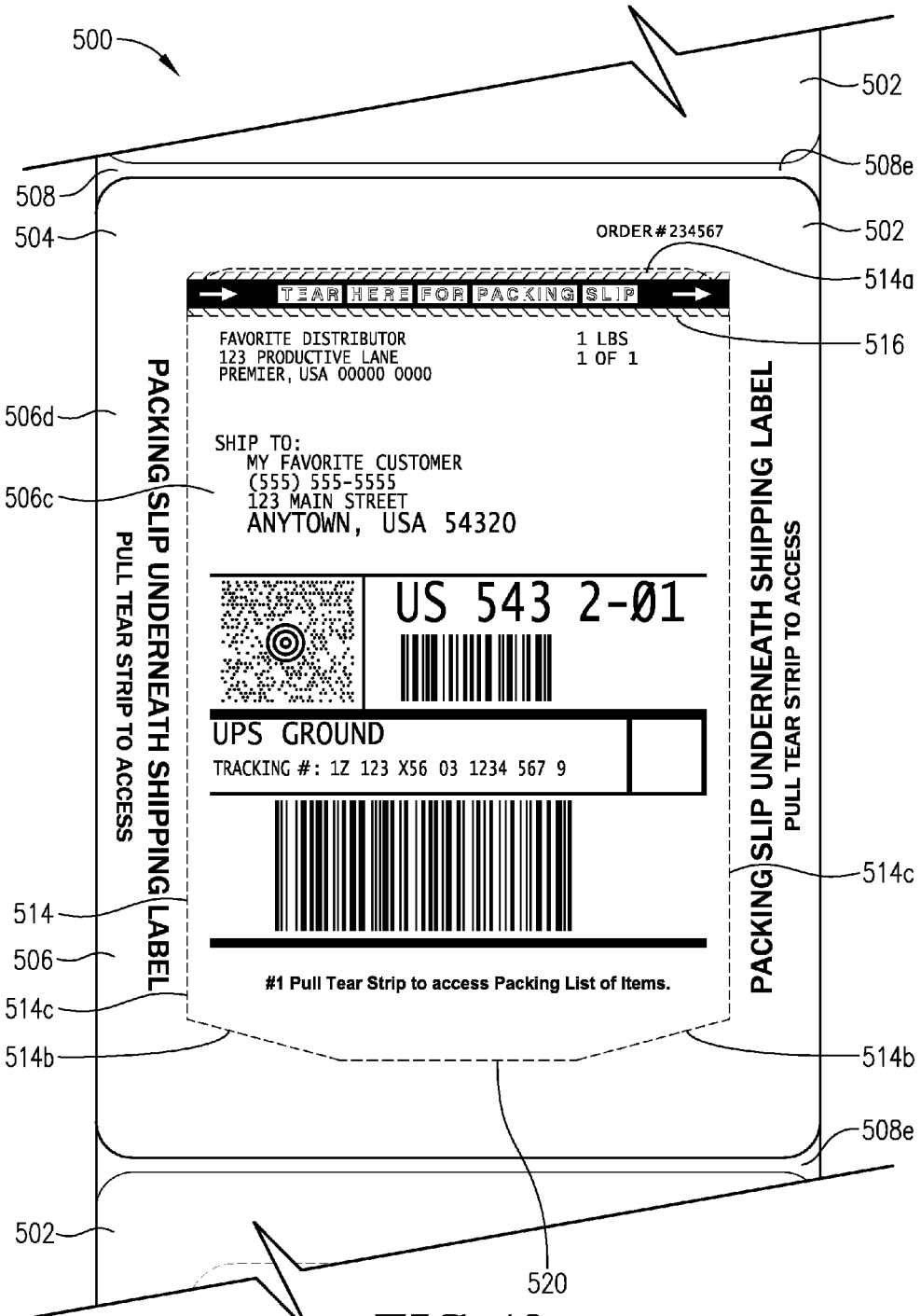
Figure 13:
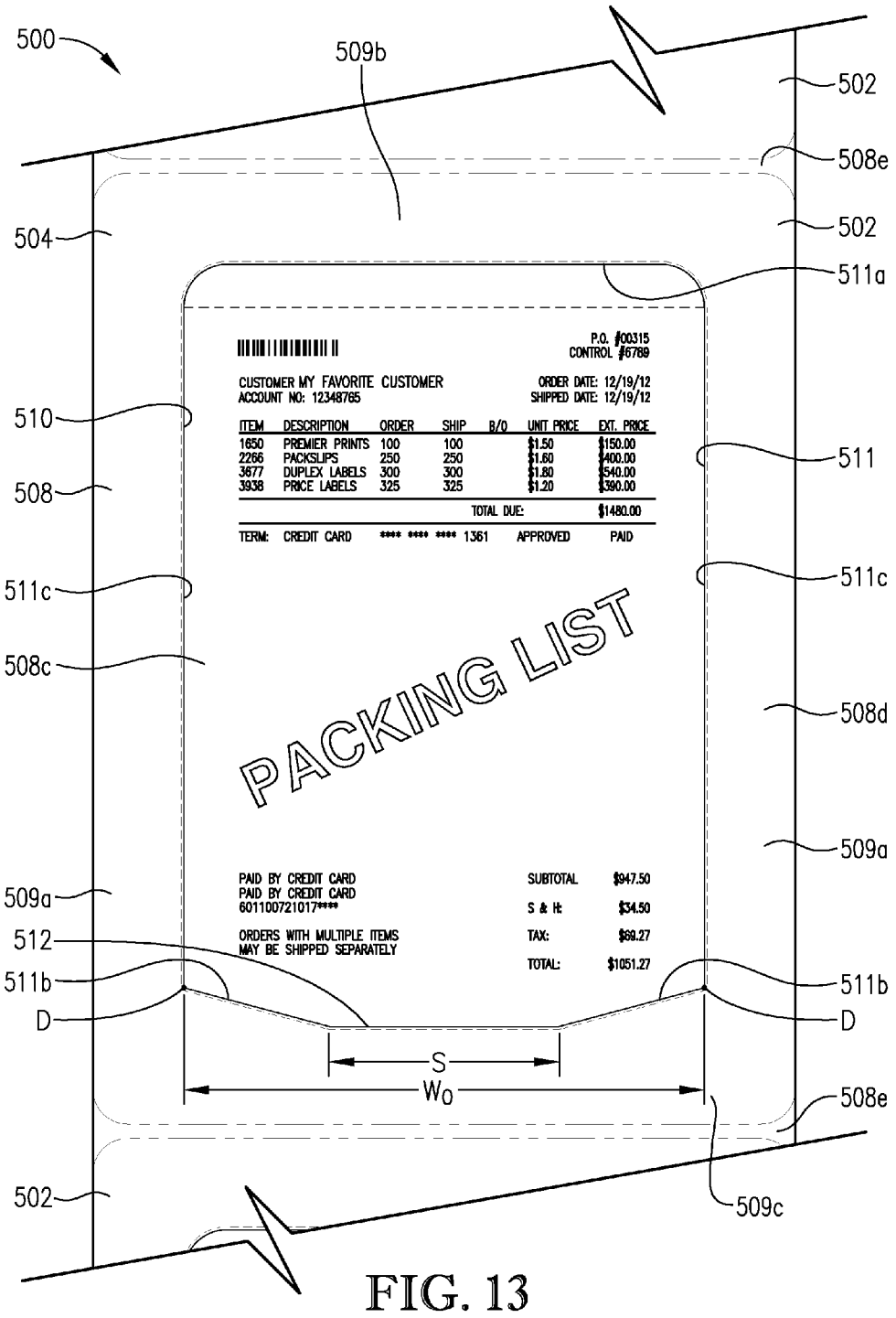

Preferred embodiments of the invention are described in detail below with reference to the attached drawing figures, wherein:

FIG. 1 is an upper perspective of a multiple-ply label system constructed in accordance with a first preferred embodiment of the present invention, with the label system including an automated print and apply station and a label supply including a plurality of multiple-ply labels attached end-to-end in a label web and wound onto a roll;

FIG. 2 is a fragmentary lower perspective of the multiple-ply label system shown in FIG. 1, showing top and bottom plies of the label web, with a border portion of the bottom ply being removed in a removal direction from a central portion of the bottom ply and the top ply, with a label being separated from the label web and positioned on an applicator pad of the station so that the label can be applied to a package;

FIG. 3 is a fragmentary top view of the multiple-ply label roll shown in FIGS. 1 and 2, showing the top ply of the label web removably adhered to the bottom ply of the label web, with the top ply including central and border portions defined by perforations, and top indicia printed along the top face of the top ply, and with curved sections of an end perforation converging to an apex;

FIG. 4 is a fragmentary bottom view of the multiple-ply label roll shown in FIGS. 1-3, showing the bottom ply of the label web, with the bottom ply including central and border portions defined by a die cut line, an end line of weakness located adjacent one end of the central portion, and bottom indicia printed along the bottom face of the central portion, and with curved sections of an end die cut line converging to an apex;

FIG. 5 is a fragmentary top view of a multiple-ply label roll constructed in accordance with a second preferred embodiment of the present invention, showing a top ply of a label web removably adhered to a bottom ply of the label web, with the top ply including central and border portions defined by perforations, and top indicia printed along the top face of the top ply, and with straight sections of an end perforation converging to an apex;

FIG. 6 is a fragmentary bottom view of the multiple-ply label roll shown in FIG. 5, showing the bottom ply of the label web, with the bottom ply including central and border portions defined by a die cut line, an end line of weakness located adjacent one end of the central portion, and bottom indicia printed along the bottom face of the central portion, and with straight sections of an end die cut line converging to an apex;

FIG. 7 is a fragmentary top view of a multiple-ply label roll constructed in accordance with a third preferred embodiment of the present invention, showing a top ply of a label web removably adhered to a bottom ply of the label web, with the top ply including central and border portions defined by perforations, and top indicia printed along the top face of the top ply, and with sections of an end perforation converging to an apex;

FIG. 8 is a fragmentary bottom view of the multiple-ply label roll shown in FIG. 7, showing the bottom ply of the label web, with the bottom ply including a border portion that presents an interior label edge, where the interior label edge presents a window opening and bottom indicia is printed along the bottom face of the top ply central portion, and with end sections of the interior label edge converging to an apex;

FIG. 9 is an upper perspective of a multiple-ply label system constructed in accordance with a fourth preferred embodiment of the present invention, with the label system including an automated print and apply station and a label supply including a plurality of multiple-ply labels attached end-to-end in a label web and wound onto a label roll, with the label web including opposite line hole margins operable to be engaged by a tractor feed mechanism of the print and apply station to feed the label web along the station;

FIG. 10 is a fragmentary top view of the multiple-ply label roll shown in FIG. 9, showing a top ply of a label web removably adhered to a bottom ply of the label web, with the top ply including central and border portions defined by perforations, and top indicia printed along the top face of the top ply, and with each end perforation having curved sections that converge to an apex;

FIG. 11 is a fragmentary bottom view of the multiple-ply label roll shown in FIGS. 9 and 10, showing the bottom ply of the label web, with the bottom ply including central and border portions defined by a die cut line that includes opposite end die cut lines, end lines of weakness located adjacent respective ends of the central portion, and bottom indicia printed along the bottom face of the central portion, and with each end die cut line having curved sections that converge to an apex;

FIG. 12 is a fragmentary top view of a multiple-ply label roll constructed in accordance with a fifth preferred embodiment of the present invention, showing a top ply of a label web removably adhered to a bottom ply of the label web, with the top ply including central and border portions defined by perforations, and top indicia printed along the top face of the top ply, and with straight sections of an end perforation converging to a straight segment of the end perforation, where the straight segment is substantially perpendicular to the removal direction; and FIG. 13 is a fragmentary bottom view of the multiple-ply label roll shown in FIG. 12, showing the bottom ply of the label web, with the bottom ply including central and border portions defined by a die cut line, an end line of weakness located adjacent one end of the central portion, and bottom indicia printed along the bottom face of the central portion, and with straight sections of an end die cut line converging to a straight segment of the end die cut line, where the straight segment is substantially perpendicular to the removal direction.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 1-3, a label system 30 is constructed in accordance with a first preferred embodiment of the present invention. The illustrated label system 30 is preferably operable to provide automated duplex printing of multiple-ply labels and automated application of printed labels onto corresponding packages. However, as will be discussed in greater detail, the label system 30 includes labels that can be printed using various printing techniques without departing from the scope of the present invention. For instance, as will be discussed, the illustrated labels could be printed on only one side. Furthermore, it is within the ambit of the present invention where the printed labels are applied using other automated techniques or through manual application. The label system 30 broadly includes a label supply 32 and a print and apply station 34.

Turning to FIGS. 1-4, the label supply 32 is preferably in the form of a continuous roll 36, which provides a plurality of unprinted labels for printing and application onto a substrate. The label roll 36 preferably includes a plurality of labels 38 attached end-to-end and a spool 40. As will be discussed, the illustrated label 38 serves as a combination shipping and packing slip label, although the label 38 could present alternative indicia for other suitable uses of the label 38 without departing from the scope of the present invention.

In the illustrated embodiment, the label roll 36 preferably includes a continuous substrate web 42 (i.e., a label substrate) having a top ply 44 and a bottom ply 46, with an adhesive layer and a release layer therebetween, as will be discussed. Preferably, the plies each include paper stock, but the plies could include other material without departing from the scope of the present invention. Furthermore, for some aspects of the present invention, the web 42 could have an alternative number of plies. For instance, the web 42 could have a single label ply. Yet further, the web 42 could include more than two plies. Preferred features of a label web with more than two plies are disclosed in U.S. application Ser. No. 13/047,328, filed Mar. 14, 2011, entitled MULTIPLE PLY LABEL WITH ADHESIVE LAYERS, which is hereby incorporated in its entirety by reference herein The top ply 44 preferably comprises a thermal paper substrate suitable to receive direct-thermal printing thereon. However, the principles of the present invention are equally applicable where the top ply comprises paper that is suitable to be printed by other printing methods, such as thermal transfer printing, laser printing, ink jet printing, or a combination of these methods. The bottom ply 46 preferably comprises a paper substrate that is used principally as a liner and receives printed indicia thereon via thermal transfer printing. However, the bottom ply could include paper that is suitable for printing by other methods, such as direct-thermal printing, laser print, ink jet printing, or a combination of these methods. Also, for some aspects of the present invention, the bottom ply 46 could be devoid of printed indicia. Yet further, any downwardly facing ply surface could be devoid of printed indicia.

The web 42 presents the end-to-end labels 38 and is preferably wound in a roll onto the spool 40. However, the principles of the present invention are applicable where the labels 38 are provided in an alternative configuration for printing and application. For instance, the labels 38 could be attached end-to-end in a fan-fold configuration where adjacent labels 38 are folded on top of one another.

Turning to FIGS. 2-4, the multiple-ply labels 38 are each preferably configured to receive indicia and broadly include the plies 44,46, an overlying release coating 48, and an adhesive layer 50 (see FIGS. 2 and 3). For each label 38, the illustrated plies 44,46 are generally rectangular in shape to present spaced apart ends and relatively longer sides extending between the ends. The preferred label 38 includes opposite label side edges 52 that define a substantially continuous width W (see FIG. 3). The top ply 44 presents opposite label end edges 54 that define a length L (see FIG. 3). Preferably, the width W is in the range of about one (1) inch to about eight (8) inches and, more preferably, about three (3) inches to about seven (7) inches. The length L is preferably in the range of about one (1) inch to about fourteen (14) inches and, more preferably, about six (6) inches to about ten (10) inches.

Each of the plies 44,46 preferably presents top faces 44*a*,46*a* and bottom faces 44*b*,46*b* that each extend to respective face outer edges. The top face 44*a* of the top ply 44 is preferably printable by direct-thermal printing methods. The bottom face 46*b* of the bottom ply 46 is preferably printable by thermal transfer printing. Again, the principles of the present invention are equally applicable where the label 38 is configured to be printed using other methods, e.g., laser printing, ink jet printing, or a combination of the above-referenced printing methods.

The release coating 48 permits the plies 44,46 to be removably adhered to one another, as will be discussed. The release coating 48 is preferably applied in a continuous layer on the top face 46*a* of the bottom ply 46 so as to cover the entire top face 46*a*. It is also within the ambit of the present invention where the release coating 48 is patterned. For instance, a release coating could be print-applied along only a border portion bottom ply 46 so that the central portions of the top and bottom plies 44,46 are permanently adhered to one another.

Also, for some aspects of the present invention the label 38 could be devoid of release coating. For instance, the adhesive layer 50 could be comprised of a temporary adhesive that permits removal of the plies 44,46 from one another without the use of release coating. The release coating 48 preferably comprises a silicone coating, although the release coating could include another material to provide a release mechanism.

The illustrated adhesive layer 50 serves to removably adhere the plies 44,46 to one another. The adhesive layer 50 is preferably applied in a continuous layer on the bottom face 44*b* of the top ply 44 so as to cover the entire bottom face 44*b*. Thus, the adhesive layer 50 preferably adheres the top and bottom plies 44,46 to each other. However, the principles of the present invention are equally applicable where the adhesive layer 50 is patterned.

Preferably, the illustrated adhesive layer 50 extends outwardly to an outer adhesive margin that preferably extends along the edges 52,54 (see FIGS. 3 and 4). This construction reduces the risk of inadvertent label removal (e.g., during shipping). However, the principles of the present invention are applicable where one or both of the plies 44,46 extend outwardly from the adhesive layer 50 (e.g., to provide an outer adhesive-free part of the label 38).

The illustrated plies 44,46 each preferably include a central portion 44*c*,46*c* and a border portion 44*d*,46*d* (see FIGS. 3 and 4). The bottom ply 46 also preferably includes an intermediate portion 46*e* that interconnects adjacent border portions 46*d*. Each of the illustrated border portions 44*d*,46*d* preferably extends endlessly about the respective central portions 44*c*,46*c*, although the border portions could have an alternative configuration (e.g., where the border portion 44*d* is separated into two sections by a tear strip that extends from one label side edge 52 to the opposite label side edge 52).

The top ply 44 preferably has adhesive layer 50 applied on both portions 44*c*,44*d*. However, as will be shown in a subsequent embodiment, the adhesive layer 50 could be applied only along one of the border and central portions 44*c*,44*d*. The bottom ply 46 preferably has release coating 48 applied along both central and endless border portions 46*c,d*. However, it is within the scope of the present invention where release coating 48 is applied only along one of the portions 46*c,d*. For instance, release coating 48 could be applied only along border portion 46*d* on the top face 46*a* so that the central portion 46*c* of the top face 46*a* is devoid of release coating 48 and the central portions 44*c*,46*c* are permanently adhered.

The adhesive layer 50 and release coating 48 are provided so that border and intermediate portions 46*d,e* are removable from the top ply 44 so that the label 38 can be adhered to package P. In the illustrated embodiment, separation of the border and intermediate portions 46*d,e* from the top ply 44 preferably proceeds along the label 38 in a removal direction D (see FIG. 2).

The illustrated adhesive layer 50 preferably comprises a permanent adhesive. As used herein, the term "permanent adhesive" refers to an adhesive that is operable to adhere a label ply to the package P, to another label ply, or to another substrate, with removal of at least part of the label ply from adhesion to the substrate resulting in physical damage to the label ply and/or the substrate, and with the damage being visibly evident to the naked eye. In this manner, the use of permanent adhesive serves to make the applied label 38 tamper-evident. Any of various suitable permanent adhesives, such as pressure sensitive adhesive, could be employed to adhere the label plies to one another. However, according to some aspects of the present invention, the adhesive layer 50 could alternatively comprise a temporary adhesive, i.e., adhesive that permits label ply removal without visibly damaging the label ply or substrate and repositioning of the label ply in adhesive engagement with the same or another substrate. For some aspects of the present invention, another mechanism could be used to cause the label 38 to be tamper-evident.

The bottom ply 46 includes an endless line of separation 56 with end portions 56*a,b* and side portions 56*c* that extend along corresponding sides of the ply (see FIG. 4). The bottom ply 46 also preferably includes an end line of weakness 58 positioned adjacent one end portion 56*a* of the bottom ply 46. The line of separation 56 extends along and is defined partly by an interior edge 57 of the bottom ply 46. The interior edge 57 includes generally longitudinal side edges 57*a* and generally transverse end edges 57*b,c*.

Preferably, the end edge 57*b* is substantially linear and extends from one side edge 57*a* to the other side edge 57*a*. Also, the end edge 57*b* is preferably substantially perpendicular to the removal direction D.

The side edges 57*a* are preferably linear and substantially parallel to the removal direction D. However, it is within the scope of the present invention where the side edges 57*a* extend along the removal direction D at an oblique angle thereto. For instance, the side edges 57*a* could generally converge from one end of the label 38 to the other end. Also, the side edges 57*a* could have a curvilinear shape.

Preferably, the end edge 57*c* includes curved segments that intersect and extend inboard from the side edges 57*a*. However, it will be appreciated that the curved segments could extend to a location spaced from the side edges 57*a*. The curved segments preferably converge in the removal direction D toward an apex 57*d*. Thus, the illustrated apex 57*d* is generally rounded, with the entire end edge preferably being curvilinear. Also, the apex 57*d* is preferably centrally located relative to the width of the window defined by the bottom ply 46. The curved segments are configured so that the end edge 57*c* bows in a generally outboard direction. The illustrated end edge 57*c* is preferably devoid of any straight segment that is at least substantially perpendicular to the removal direction D. It has been found that such a label configuration promotes automated separation of the border portion 46*d* and the top ply 44 along the removal direction D by the station 34. However, for some aspects of the present invention, the end edge 57*c* could have a straight segment that is perpendicular to the removal direction D, as will be shown in a subsequent embodiment.

Preferably, the side edges 57*a* at least partly define side sections 59*a* of the border portion 46*d*, and the end edges 57*b,c* at least partly define end sections 59*b,c* of the border portion 46*d* (see FIG. 4). Furthermore, the end sections 59*b,c* preferably interconnect the side sections 59*a*. While the illustrated label 38 preferably has opposite end sections 59*b,c*, for some aspects of the present invention the label 38 could have one end section. As will be discussed, the end section 59*c* located opposite the tear strip is removed generally after the side sections 59*a* when the border portion 46*d* is removed from the top ply 44 in the removal direction D.

The interior edge 57 is preferably spaced inboard from the side and end edges 52,54 so that a central window is defined in the bottom ply 46. However, for some aspects of the present invention, the interior edge 57 could extend to at least one of the edges 52,54. The illustrated border portion 46*d* is preferably defined between the interior edge 57 and edges 52,54. The bottom ply 46 could also have other lines of separation and/or lines of weakness. As will be discussed, the end line of weakness 58 extends in registration with an end perforation in the top ply 44. The principles of the present invention are also applicable where no end line of weakness 58 is included.

The lines of separation 56 preferably comprise die cut lines. However, it is also within the scope of the present invention where score lines or perforation lines are used in place of the lines of separation 56. Also, as will be shown in a subsequent embodiment, the bottom ply 46 could present a continuous opening defined by the interior edge 57. Preferably, the endless lines of separation 56 extend between and thereby define central and border portions 46*c,d* of the bottom ply, with the central portion 46*c* being removable from the border portion 46*d*. It is within the ambit of the present invention where the central portion and/or border portion of bottom ply 46 have different shapes and/or sizes.

The top ply 44 further includes perforation 60 with portions 60*a,b,c* and end perforation 62 (see FIG. 3). The end portion 60*a* is perpendicular to the removal direction and extends from one side portion 60*c* to the other side portion 60*c*.

Sections of the end portion 60*b* preferably extend from respective side portions 60*c*. However, it will be appreciated that the end portion 60*b* could be spaced from one or both of the side portions 60*c* while cooperating with side portions 60*c* to provide a perforation line. For instance, the perforation segments of end and side portions 60*b,c* could result in the portions 60*b,c* not intersecting one another.

The sections of portions 60*b* extend from side portions 60*c* and preferably converge to an apex 64. Preferably, the perforations 60,62 extend between and thereby define central and border portions 44*c,d* of the top ply 44, with the central portion 44*c* being entirely removable from the border portion 44*d*. However, for some aspects of the present invention, the central portion 44*c* may not be defined by perforations. For instance, the central portion 44*c* could be defined by a score line, or the top ply 44 could be devoid of any line of weakness.

Turning to FIGS. 2 and 6, perforation 62 extends along the central portion between ends of perforation 60, with perforation 62 being inwardly spaced from and adjacent to perforation 60*a*. Preferably, perforations 60,62 cooperatively define a tear strip 66 of the central portion 44*c* that connects portions of the top ply 44 to one another. The illustrated tear strip 66 preferably extends from one side portion 60*c* of perforation 60 to another side portion 60*c* (see FIG. 3). Furthermore, the illustrated tear strip 66 is configured to be initially separated at a left tear strip end 66*a* adjacent the side portion 60*c* so that the left tear strip end 66*a* can be pulled by a user in a direction toward the right tear strip end 66*b* and the side portion 60*c* to further separate the tear strip 66. However, the tear strip 66 could be alternatively configured to provide user access. For example, the tear strip 66 could extend across both the central and border portions 44*c,d* so that both of the tear strip ends 66*a,b* extend to respective label side edges 52. Alternatively, the tear strip 66 could be positioned with one of the tear strip ends 66*a,b* at a respective label side edge 52 and the other of the tear strip ends 66*a,b* extending to a respective side portion 60*c* but not across the border portion 44*d*.

Furthermore, the tear strip 66 could be arranged to extend along the length of the label 38. For instance, the tear strip 66 could extend from end perforation 62 to the perforation end portion 60*b*. The tear strip 66 could also extend from one label end edge 54 to the other label end edge 54. Alternatively, the tear strip 66 could extend longitudinally so that one of the tear strip ends 66*a,b* at a respective label end edge 54 and the other one of the tear strip ends 66*a,b* is at a respective one of the perforation 62 and perforation end portion 60*c*. It is also within the scope of the present invention where the top ply 44 does not include tear strip 66.

When the top and bottom plies 44,46 are adhered in registration with one another, the die cut lines and perforations 60,64 of the plies are preferably aligned so that the central portions 44*c*,46*c* are substantially the same size and are superposed with each other. Furthermore, the border portions 44*d*,46*d* are preferably substantially the same size and are superposed with each other when the top and middle plies 44,46 are adhered in registration with each other. However, for some aspects of the present invention, the die cut lines and perforations 60,64 of plies 44,46 could be offset from one another. Also, the central portions or border portions of plies 44,46 could have different shapes and/or sizes.

The label 38 preferably includes the tear strip 66 so that the tear strip 66 and a strip 68 of the bottom ply 46 can be removed to present an unsupported margin of the central portions 44*c*,46*c* adjacent to the strips 66,68. In the illustrated embodiment, the tear strip 66 and strip 68 are removed from the plies 44,46 during separation. The unsupported margin permits a user to grab the central portions 44*c*,46*c* of each ply and remove the central portions 44*c*,46*c* from the label 38 by pulling the margin in a direction toward the opposite end of the label 38. However, it is within the ambit of the present invention where the label 38 has an alternative feature to provide user access to central portions. For instance, the label 38 could present an opening between the central and border portions 44*c*,44*d* to provide user access to the central portions and, particularly, to the bottom ply. Again, the illustrated tear strip 66 is preferably positioned at one end of the central portion 44*c*, but could be alternatively positioned (e.g., along one side of the central portion 44*c*) without departing from the scope of the present invention.

Turning again to FIGS. 2-4, the printed label 38 preferably includes top and bottom indicia 72,74 printed respectively on the top face 44*a* of the top ply 44 and the bottom face 46*b* of the bottom ply 46. In this manner, the top face 44*a* and bottom face 46*b* preferably serve as top and bottom faces of the label 38 to provide a shipping and packing slip label arrangement. However, for some aspects of the present invention, the bottom face 46*b* could be devoid of printed indicia. For instance, a shipping and packing slip label assembly could be provided by adhering a pair of labels 38 to one another. In particular, an upper label 38 having shipping indicia could be adhered in registry over another label 38 having packing slip indicia. Preferred features of a label-over-label arrangement are disclosed in the above-incorporated '328 application.

As will be shown, the indicia 72,74 may include variable indicia (i.e., indicia that can vary with each label and associated package P) and non-variable indicia (i.e., indicia that generally does not change from label to label or from order to order). Furthermore, some of the indicia may be preprinted (e.g., before the web 42 is wound onto spool 40). The top indicia 72 presented on top face 44*a* includes sender address indicia 76, recipient address indicia 78, package size and package number indicia 80, bar code indicia 82 operable to provide a unique identifier associated with the package P that can be electronically scanned, package tracking indicia 84 operable to identify the carrier and a unique carrier tracking number associated with the package P, margin indicia 86, and tear strip indicia 88 (see FIG. 3). The illustrated top indicia 72 is printed across the central and border portions 44*c,d*, but the principles of the present invention are applicable where the indicia 72 is alternatively printed on the portions 44*c,d* or is printed on only one of the portions 44*c,d*. As will be discussed, the top indicia 72 is generally exposed and visible when the label 38 is applied to the package P.

Turning to FIG. 4, the bottom indicia 74 presented on the bottom face 46*b* includes packing list indicia 90, customer and account indicia 92, bar code indicia 94 operable to provide a unique identifier associated with the package P that can be electronically scanned, package order indicia 96, and slip indentification indicia 98. The package order indicia 96 is operable to identify the order number, control number, order date, ship date, subtotal cost, shipping and handling cost, tax, total cost, and credit card payment information associated with the package P. The illustrated bottom indicia 80 is preferably printed on the central portion 46*c* and is generally hidden from view when the label 38 is applied to the package P (see FIG. 1). However, the principles of the present invention are applicable where at least some indicia printed on the bottom face 46*b* is printed on the border portion 46*d* or on both of the central and border portions 46*c,d*.

The top indicia 72 are preferably printed by direct-thermal printing. However, the top indicia 72 could be printed by other printing methods, such as thermal transfer, laser, ink jet printing, or a combination of printing methods. The bottom indicia 74 are preferably printed by thermal transfer print. The bottom indicia 74 could also be printed by other printing methods, such as direct-thermal, laser, ink jet printing, or a combination of printing methods. It is also within the scope of the present invention where the top and bottom indicia 72,74 are printed by the same printing method, e.g., by direct-thermal printing. Also, one of the indicia 72,74 could be printed by ink jet printing and the other one of the indicia 72,74 could be printed by direct-thermal printing.

The indicia 86,88,98 generally comprise non-variable indicia. Indicia 76,78,80,82,84,90,92,94,96 generally includes variable indicia. Thus, both faces of the label 38 include variable indicia, and variable indicia on both faces of the label 38 can be associated with a particular customer order contained within package P. As will be discussed further, in printing indicia on both label faces, the indicia 72 on the top face 44*a* can be matched with the indicia 74 on the bottom face 46*b* to provide all of the indicia associated with the corresponding order. This facilitates proper shipment of the correct items to the correct recipient.

The illustrated label 38 is configured so that the bottom indicia 74 is located on the bottom face 46*b* along the central portion 46*c* and is thereby hidden when the label 38 is applied to the package P. Thus, the label 38 must be at least partly removed from the package P to access the bottom indicia 74. Due to this tamper-evident label construction, the label 38, package P, or both are visibly damaged when the label 38 is at least partly removed from the package P.

The top and bottom indicia 72,74 comprise the only information associated with the package P that is carried by the illustrated label for visual and electronic identification (by the sender, distributor, or recipient) of the package P and the associated customer order. But it is also within the ambit of the present invention where the label 38 includes other package or order identification features, e.g., other types of machine-readable features. For instance, the label 38 could include an RFID tag attached to the plies that can carry information in electronic form and can be electronically programmed and read.

Turning again to FIG. 1, the labels 38 are preferably attached end-to-end to form the continuous web 42, and the web 42 is wound to form the roll 36. Preferably, the bottom ply 46 extends continuously along the length of the web 42, and the top ply 44 includes a plurality of ply sections spaced along the length of the bottom ply 46. However, it is within the scope of the present invention where the top ply sections are separated by a line of separation or weakness. Furthermore, the top ply 44 could extend continuously along the length of the web 42. The web 42 is mounted to the spool 40 with the top face 44*a* engaging the spool 40.

As the web 42 is wound to form the roll 36, the bottom face of each label 38 overlies the top face of the underlying label 38 on the roll 36. The end-most label 38, i.e., the label 38 at an exposed end of the web 42, can be removed from overlaid engagement with the label 38 therebelow and can be separated from the web 42 between itself and the adjacent label 38. As mentioned above, the labels 38 could be organized for use in an alternative configuration. For instance, the labels 38 could be attached end-to-end in a fan-fold configuration where adjacent labels 38 are folded on top of one another.

Turning again to FIGS. 1 and 2, the station 34 is configured to print and apply a label 38 to package P. The station 34 includes a housing 100, upper and lower print heads 102,104, a label applicator 106, a take-up roll 108, a guide 109, incoming rolls 110, outgoing rolls 112, and a powered conveyor 114. The web 42 is fed from the roll 36, through rolls 110, through print heads 102,104, through rolls 112, and to take-up roll 108. The station 34 is configured to print the label 38 in a single printing pass, as will be discussed. The print heads 102,104 are configured to print indicia 72,74 on corresponding top and bottom faces 44*a*,46*b*.

The conveyor 114 preferably includes multiple rollers and an endless belt entrained around the rollers, with one of the rollers being powered. However, it is also within the scope of the present invention where the conveyor 114 has an alternative configuration. For instance, the conveyor 114 could be unpowered, e.g., where the conveyor includes a series of unpowered rolls spaced along the length of the conveyor.

As the web 42 passes through the print heads 102,104, the top and bottom faces 44*a*,46*b* are preferably printed simultaneously as the label 38 is fed continuously through the print heads 102,104. However, the principles of the present invention are applicable where the faces 44*a*,46*b* are printed sequentially during the single printing pass. The single printing pass could involve some back-and-forth movement of the label 38 as the label 38 is being printed.

The illustrated print head 102 is preferably a direct-thermal print head and the print head 104 is preferably a thermal transfer print head. However, the principles of the present invention are applicable where the station 34 includes another type of print head, such as a laser head, an ink jet head, or an alternative combination of print head types. For instance, the station 34 could be configured so that both print heads 102,104 are direct-thermal print heads. Furthermore, multiple types of print heads could be used to print either the top or bottom faces 44*a*,46*b*.

While the top indicia 72 on the label 38 is printed by the station 34 using direct-thermal printing, it is also within the scope of the present invention where at least some of the indicia on the label is printed using thermal transfer, laser, ink jet printing, or a combination of these printing methods. Similarly, while the bottom indicia 74 is printed using thermal transfer printing, it is also within the scope of the present invention where at least some of the indicia on the label is printed using direct-thermal, laser, ink jet printing, or a combination of these printing methods. Furthermore, some of the indicia 72,74, particularly the non-variable indicia, could be pre-printed on the continuous web 42 (i.e., prior to printing by the station 34).

As discussed above, the label system 30 is operable to print the labels 38 on both faces with variable indicia, such as recipient address indicia and sender address indicia. All of the variable indicia printed on the label 38 is associated with the particular package P, the contents of the package P, and the recipient of the package P. Therefore, the system 30 associates (or matches) all of the variable indicia for each label 38 prior to printing of the label 38. For example, the station 34 preferably includes a computer (not shown) for compiling and associating the information for each label 38. The station 34 also controls the print heads 102,104 so that the associated (or matched) indicia is printed on the same label 38. It is also within the scope of the present invention where only some portions of the variable indicia printed on the label 38 are associated with each other. Also, while the illustrated variable indicia is associated with the corresponding package P, some variable indicia could be associated by another type of association.

The label applicator 106 is configured to apply label 38 to package P when the package P is in a labeling position (see FIG. 1). The applicator 106 includes an applicator arm 116 and an applicator pad 118 attached to the end of the arm 116. Preferably, the label applicator 106 further includes a vacuum source (not shown) that is operably coupled to the pad 118. The vacuum source is operable to produce a vacuum condition adjacent a lower pad surface 120 of the pad 118 so that the vacuum pressure (i.e., pressure less than ambient pressure) provided by the vacuum source is sufficient to hold the label 38 against the lower pad surface 120. Also, the vacuum source is operably coupled to a controller (not shown) of the label applicator 106 so that the controller can operate the vacuum source to selectively apply or remove the vacuum condition. Thus, the label applicator 106 is preferably configured so that one of the labels 38 can be held in engagement with the lower pad surface 120 when the vacuum condition is applied.

The illustrated station 34 preferably automatically separates the border portion 46*d* and intermediate portion 46*e* of the bottom ply 46 from the remainder of the web 42 to provide labels 38 in a separated form (i.e., where the label 38 has the border portion 46*d* removed). As discussed, the web 42 passes through the print heads 102,104. The web 42 then passes over an uppermost rounded end 122 of the guide 109. Because the web 42 is drawn over the rounded end 122, the rounded end 122 bends the bottom ply 46 through an angle of about ninety (90) degrees.

The top ply 44 is urged to separate from the border and intermediate portions 46*d,e* of the bottom ply 46 as the web 42 proceeds beyond the rounded end 122. For instance, the strength of the top ply 44 causes some restriction to bending of the top ply 44. Also, the vacuum produced adjacent the lower pad surface 120 urges the top ply 44 to remain in contact with the lower pad surface 120 as the web 42 is advanced. As a result, the border and intermediate portions 46*d,e* are removable from the top ply 44, with separation proceeding along the label in the removal direction D (see FIG. 2). As the border and intermediate portions 46*d,e* are separated from the top ply 44 along the removal direction D, the end section 59*c* is generally removed after the side sections 59*a*. The separated portions 46*d*,46*e* proceed downwardly and over a lowermost rounded end 124 of guide 109 as the web 42 is advanced, with the separated portions 46*d*,46*e* continuing through the rolls 112 and toward the take-up roll 108.

The arm 116 is slidably mounted to a housing of the applicator 106 so that the arm 116 can reciprocate relative to the housing. The label applicator 106 also preferably includes a motor (not shown), such as a pneumatic or electric servo motor, drivingly attached to the arm 116 and operable to shift the arm 116 relative to the housing. The controller of the label applicator 106 is operably coupled to the motor so that the controller can operate the motor to selectively move the arm 116 and pad 118 between a retracted position (see FIGS. 1 and 2) and an extended position (not shown). In the retracted position, the pad 118 is preferably spaced from the package P (e.g., to allow shifting of the package P into or out of the labeling position). In the extended position, the pad 118 is positioned adjacent to or in direct contact with package P, when the package P is in the labeling position, to apply the separated label 38 to the package P.

The illustrated label applicator 106 is operable to locate the pad 118 in the retracted position to receive and hold a label 38 for subsequent application to the package P. Again, in the retracted position, the vacuum condition is applied so that the endmost label 38 is drawn into engagement with the lower pad surface and held in place. Furthermore, the vacuum condition is preferably maintained as the pad 118 and the separated label 38 are shifted from the retracted position to the extended position.

The label applicator 106 is operable to shift the arm 116 and pad 118 into the extended position to apply the held label 38 to the package P. Preferably, the conveyor 114 continuously moves the package P in the indicated direction as the label 38 is applied to the package P. However, it is also within the scope of the present invention where the conveyor 114 momentarily stops the package P for label application. The label applicator 106 can then return the arm 116 and pad 118 from the extended position to the retracted position so that another label 38 can be applied to another package. The illustrated station 34 preferably includes a TwinPrint Automated Printer Applicator manufactured by FOX IV Technologies, Inc. of Export, Pa., although other types of printers and/or print-and-apply systems could be used.

For some aspects of the present invention, a hand-apply label printer could be used to print labels that are subsequently manually applied. The web 42 could include perforation lines that extend between and separate adjacent labels 38 so that the endmost label can be manually removed from the web 42, with or without the use of a label cutter. Hand-apply label printers would preferably use the web 42 in a fan-fold configuration, although such printers could also utilize the web 42 in a roll form.

While the system 30 preferably includes the automated print and apply station 34, it is within the scope of the present invention where some steps of the label print and application process are performed manually. Because the station 34 is configured to print variable indicia on both label faces, the station 34 can also apply labels 38 to a plurality of packages P, where each package P has at least some indicia that is different from the other packages P. For instance, the station 34 is operable to print and apply labels 38 to multiple packages P, with each package P having different contents and each label 38 having different indicia associated with the contents (e.g., where the recipient address indicia is different between each package P).

The printed label 38 can be adhered to package P by removing the border portion 46*d* of bottom ply 46. Again, the adhesive layer 50 and release coating 48 permit removal of the border portion 46*d* and intermediate portion 46*e* so that the label 38 is separated from the web 42. The illustrated station 34 preferably automatically removes the border and intermediate portions 46*d,e* of the bottom ply 46. However, the principles of the present invention are applicable where the portions 46*d,e* are removed manually.

The label 38 is preferably adhered in a flat, unfolded condition. It has been found that applying the label 38 in a flat and unfolded condition on package P is preferable, particularly for multiple-ply shipping labels, because the label 38 is resistant to inadvertent damage or removal caused by package handling and distribution. Importantly, the illustrated label 38 effectively resists damage caused by exposure to handling equipment of large-volume parcel shippers.

The central portions 44*c*,46*c* of the adhered label 38 are removable from the border portion 44*d* of the top ply 44 by initially separating the tear strip 66 from the border portion 44*d*. In particular, one end of the tear strip 66 is grabbed and drawn by the user toward the other end of the tear strip 66.

The tear strip 66 can be either partly or completely removed, and this separation of the tear strip 66 leaves the label 38 in an unsecured configuration where the bottom indicia 74 is no longer securely concealed. Furthermore, the unsupported margin of the central portions 44*c*,46*c* is exposed to permit the user to grab the central portions 44*c*,46*c*. The margin can then be drawn away from the border portion 44*d* to separate the central portions 44*c*,46*c* from the border portion 44*d* to a greater degree and enable access to the bottom ply 46. The central portions 44*c*,46*c* can also be completely detached from the border portion 44*d*.

In the illustrated embodiment, the central portions 44*c*, 46*c* cooperatively provide a packing slip 126. However, the principles of the present invention are also applicable where the packing slip 126 is provided for other uses, such as a return label. For instance, part of the central portion 44*c* could include an adhesive return label that can be adhesively applied to the package P or to another substrate. Preferred features of an exemplary label having an adhesive return label are disclosed in the above-incorporated '328 application.

In operation, the label system 30 is operable to efficiently apply labels 38 to multiple packages while minimizing label waste. The label roll 36 dispenses the continuous web 42 of labels 38 into the print heads by unrolling an endmost label 38 from overlaid engagement with underlying labels. The illustrated labels 38 include no pre-printed indicia, although some pre-printed indicia may be included on the web 42 prior to printing with the station 34.

As the labels 38 are shifted through the print heads 102,104 toward the applicator pad 118, indicia 72,74 is printed on top and bottom faces 44*a*,46*b*. The printed labels 38 are separated from the web 42 and received by the bottom surface of the pad 118. Once the border portion 46*d* is removed from the label 38 and the package P is generally in or adjacent to the labeling position, the pad 118 moves with the label 38 from the retracted position to the extended position so that the label 38 is adhered to the package P. Preferably, the conveyor 114 continuously moves the package P in the indicated direction as the label 38 is applied to the package P. Again, it is also within the scope of the present invention where the conveyor 114 momentarily stops the package P for label application. The border portion 44*d* secures the label 38 to the package P using the adhesive layer 50 so that the bottom indicia 74 is hidden by the label 38 and package P in a secured label configuration. In addition, the top face 44*a* is exposed to permit viewing and electronic scanning of indicia 72.

The bottom ply 46 and bottom indicia 74 are exposed by first removing the tear strip 66 from the top ply 44 to present the unsupported margin. The recipient can then grasp the exposed margin to remove the central portions 44*c*,46*c* from the border portion 44*d*. By exposing the bottom ply 46, the packing slip 126 can be removed from central portion 44*c*.

Turning to FIGS. 5-13, alternative preferred embodiments of the present invention are depicted. For the sake of brevity, the remaining description will focus primarily on the differences of these alternative embodiments from the preferred embodiment described above.

Initially turning to FIGS. 5 and 6, an alternative label roll 200 includes a plurality of labels 202. The labels 202 are each constructed to provide a shipping and packing slip label. The label roll 200 preferably includes a continuous substrate web 204 having an alternative top ply 206, an alternative bottom ply 208, a release coating (not shown), and an adhesive layer (not shown).

The plies 206,208 each preferably include a central portion 206*c*,208*c* and a border portion 206*d*,208*d*. The bottom ply 208 also preferably includes an intermediate portion 208*e* that interconnects adjacent border portions 208*d*.

The bottom ply 208 includes an endless line of separation 209 partly formed by an interior edge 210. The interior edge 210 has end edges 210*a,b* and side edges 210*c* that extend along corresponding sides of the ply. In the illustrated embodiment, the end edges 210*b* each extend from an end of the respective side edge 210*c* to an apex 212. In this manner, the central portion 208*c* tapers to the apex 212. The end edges 210*b* are preferably substantially straight (i.e., the end edges 210*b* are substantially linear).

The top ply 206 includes perforations 214 with end perforations 214*a,b* and side perforations 214*c*, and also includes end perforation 216. The portions 214*c* extend from ends of the respective end perforations 214*c* to an apex 220. Thus, the central portion 206*c* tapers to the apex 220. In the illustrated embodiment, the perforations 214 are preferably substantially aligned with corresponding portions of line of separation 210. The perforation 216 is also preferably substantially aligned with an end line of weakness 222 in the bottom ply 208.

Turning to FIGS. 7 and 8, an alternative label roll 300 includes a plurality of labels 302. The labels 302 are each constructed to provide a shipping and packing slip label. The label roll 300 preferably includes a continuous substrate web 304 having an alternative top ply 306, an alternative bottom ply 308, a release coating 309, and a patterned adhesive layer 310 (see FIG. 7).

The top ply 306 preferably includes a central portion 306*c*. The plies 306,308 preferably include a border portion 306*d*,308*d*. The bottom ply 308 also preferably includes an intermediate portion 308*e* that interconnects adjacent border portions 308*d*. Thus, the border portion 308*d* of the bottom ply 308 preferably provides an open window that presents a central window opening 311.

The bottom ply 308 includes an endless interior edge 312 with end portions 312*a,b* and side portions 312*c* that extend along corresponding sides of the ply. In the illustrated embodiment, the end portions 312*b* each extend from ends of the respective side portions 312*c* to an apex 314. Thus, the edge 312 preferably defines the opening 311. However, it is within the ambit of the present invention where other edge sections define at least part of the opening 311.

The top ply 306 includes perforation 316 with end portions 316*a,b* and side portions 316*c*, and also includes end perforation 318. The portions 316*b* extend from an end of the respective portions 316*c* to an apex 322. Thus, the central portion 306*c* tapers to the apex 322.

The illustrated label 302 preferably includes top and bottom indicia 324,326. The top indicia 324 is applied to a top face 306*a* of the top ply 306. The bottom indicia 326 is applied to a bottom face 306*b* of the top ply 306, with the bottom indicia 326 being located on the central portion 306*c*. Thus, when the plies 306,308 are adhered to one another, the opening 311 permits the bottom indicia 326 to be exposed.

As with the previous embodiments, the border portion 308*d* is separated from the top ply 306 so that the label 302 can be adhered to the substrate. Thus, when the illustrated label 302 is adhered to the substrate, the top ply 306 comprises the only ply of the adhered label 302.

Turning to FIGS. 9-11, an alternative label system 400 broadly includes an alternative label roll 402 and an alternative print and apply station 404.

The label roll 402 includes a plurality of labels 406. The labels 406 are each constructed to provide a shipping and packing slip label. The label roll 402 preferably includes a continuous substrate web 408 having an alternative top ply 410, an alternative bottom ply 412, a release coating (not shown), and an adhesive layer (not shown).

The plies 410,412 each preferably include a central portion 410*c*,412*c* and a border portion 410*d*,412*d*. The bottom ply 412 also preferably includes an intermediate portion 412*e* that interconnects adjacent border portions 412*d*. The illustrated bottom ply 412 further includes line hole margins 414 that present a plurality of line holes 416 to be engaged by a tractor feed mechanism (not shown). The illustrated line hole margins 414 project laterally outwardly from outermost side edges of the top ply 410.

The bottom ply 412 includes an endless line of separation 417 partly defined by an interior edge 418. The interior edge 418 includes end edges 418*a,b* and side edges 418*c* that extend along corresponding sides of the ply. In the illustrated embodiment, the end edges 418*a* each extend from ends of side edges 418*c* to an apex 419. The end edges 418*b* each extend from ends of side edges 418*c* to an apex 420. The end edges 418*a,b* each have a generally curved shape that bows in an outboard direction. Thus, the central portion 412*c* tapers to each apex 419,420.

The top ply 410 includes perforation 422 with end portions 422*a,b* and side portions 422*c*, and includes end perforation 424. The end portions 422*a* each extend from ends of side portions 422*c* to apex 428. The end portions 422*b* extend from ends of side portions 422*c* to apex 430. The end portions 422*a,b* each have a generally curved shape that bows in an outboard direction. Thus, the central portion 410*c* tapers to each apex 428,430.

The station 404 includes, among other things, a housing 432, a duplex printer 434, a label applicator 436, and a take-up roll 438. The printer 434 includes a conventional tractor feed mechanism to engage the line hole margins 414 and thereby feed the web 208 through the duplex printer 434. The web 408 is fed from the roll 402 and through duplex printer 434, with the printed label 406 being applied to package P. The station 404 is configured to print the label 406 in a single printing pass.

Turning to FIGS. 12 and 13, an alternative label roll 500 includes a plurality of labels 502. The labels 502 are each constructed to provide a shipping and packing slip label. The label roll 500 preferably includes a continuous substrate web 504 having an alternative top ply 506, an alternative bottom ply 508, a release coating (not shown), and an adhesive layer (not shown).

The plies 506,508 each preferably include a central portion 506*c*,508*c* and a border portion 506*d*,508*d*. The bottom ply 508 also preferably includes an intermediate portion 508*e* that interconnects adjacent border portions 508*d*. The border and intermediate portions 508*d,e* are removable from the top ply 506 in a removal direction. The border portion 508*d* includes side sections 509*a* and end sections 509*b,c*, with the end sections 509*b,c* interconnecting the side sections 509*a*. The end section 509*c* is removed generally after the side sections 509*a* when the border portion 508*d* is removed in the removal direction.

The bottom ply 508 includes an endless line of separation 510 that is partly defined by interior edge 511. The interior edge 511 includes end edges 511*a,b* and side edges 511*c* that extend along corresponding sides of the ply. In the illustrated embodiment, the end edges 511*b* are each preferably straight and extend from an end of the respective side edge 511*c* to a straight segment 512 of the interior edge 511. While the illustrated end edges 511*b* are preferably substantially linear, the principles of the present invention are also applicable where the end edges 511*b* have a curvilinear shape. Preferably, the segment 512 is substantially perpendicular to the removal direction. The straight segment 512 is preferably spaced generally equally between the side edges 511*c* so as to be centrally located relative to the window, although the segment 512 could be alternatively positioned. While the segment 512 is a single continuous perpendicular segment, it is within the scope of the present invention where multiple perpendicular segments are located between the side edges. The central portion 508*c* preferably tapers to the segment 512.

The straight segment 512 preferably presents a length dimension S that is less than about forty percent (40%) of a window width dimension Wo (see FIG. 13). More preferably, the length dimension S is less than about twenty percent (20%) of the window width dimension Wo. In the instance where multiple straight segments extend along the bottom ply 508, the total length of these segments would fall within the ranges described above. The window width dimension Wo is preferably measured immediately adjacent the straight segment 512 (e.g., the dimension is measured between points D, as shown in FIG. 13). The illustrated window has a window width that is substantially constant along the length of the window. However, it is also within the scope of the present invention where the window width changes along the window length. In that instance, the window width dimension Wo is determined adjacent the straight segment 512.

The top ply 506 includes perforation 514 with end portions 514*a,b* and side portions 514*c*, and also includes end perforation 516. The end portions 514*a,b* extend from an end of the respective side portions 514*c* to a straight segment 520. Preferably, the segment 520 is also substantially perpendicular to the removal direction. The central portion 506*c* preferably tapers to the segment 520.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A label comprising:

adhesively coupled top and bottom label plies, each of which includes top and bottom faces and an outer ply edge, with the bottom face of the top label ply and the top face of the bottom label ply being opposed when the label plies are adhesively coupled, said top label ply operable to be adhesively fixed relative to a substrate, said bottom label ply including an interior ply edge spaced at least in part from the outer ply edge such that a central window is defined in the bottom label ply, said top label ply including an outer portion that projects outwardly beyond the interior ply edge of the bottom label ply, said bottom label ply further including an outer removable border portion defined between the interior and outer ply edges, with the border portion being removable relative to the top label ply in a removal direction, and with removal of the border portion exposing the bottom face of the top label ply along the outer portion, said interior ply edge including a pair of spaced apart side edges that extend along the removal direction to define a pair of spaced apart side sections of the removable border portion, said interior ply edge including a generally transverse end edge extending between the side edges to define an end section of the removable border portion, at least part of said end section of the removable border portion being removably adhered to the top label ply, with the end section interconnecting the side sections and being removed generally after the side sections when the removable border portion is removed, said end edge being devoid of any straight segment that is at least substantially perpendicular to the removal direction.

2. The label as claimed in claim 1, said end edge including converging segments that converge in the removal direction toward an apex.

3. The label as claimed in claim 2, said apex being spaced generally equally between the side edges so as to be centrally located relative to the window.

4. The label as claimed in claim 2, said converging segments being substantially linear.

5. The label as claimed in claim 4, said converging segments joining at a point such that the apex is sharp.

6. The label as claimed in claim 2, said apex being rounded.

7. The label as claimed in claim 6, said end edge being curvilinear so as to be entirely devoid of any straight sections.

8. The label as claimed in claim 1, said side edges being linear.

9. The label as claimed in claim 8, said side edges being substantially parallel to one another and to the removal direction.

10. The label as claimed in claim 9, said label plies being generally rectangular in shape to present spaced apart ends and relatively longer sides extending between the ends, with the side edges being adjacent the sides and the end edge being adjacent one of the ends, said removal direction extending longitudinally between the ends.

11. The label as claimed in claim 1, said interior edge being continuous and including a second end edge spaced from the first-mentioned end edge, with the removable portion having opposite end sections.

12. The label as claimed in claim 11, said second end edge being substantially linear and generally perpendicular to the removal direction.

13. The label as claimed in claim 1, said bottom label ply including a line of separation defining the interior ply edge, said bottom label ply including a central ply portion located within the window.

14. The label as claimed in claim 13, said label carrying publicly displayed indicia on the top face of the top label ply and hidden indicia on the bottom face of the bottom label ply, said hidden indicia being located on the central portion of the bottom label ply.

15. The label as claimed in claim 1, said central window being open such that a corresponding part of the bottom face of the top label ply is exposed through the central window when the label plies are adhesively coupled.

16. The label as claimed in claim 15, said label carrying publicly displayed indicia on the top face of the top label ply and hidden indicia on the corresponding part of the bottom face of the top label ply.

17. The label as claimed in claim 15, said top and bottom label plies comprising the only plies of the label.

18. The label as claimed in claim 15, said bottom label ply being wholly removable relative to the top label ply, such that the top label ply is the sole ply adhered directly to the substrate.

19. The label as claimed in claim 1, said top label ply including an interior line of weakness spaced at least in part from the outer ply edge to present a separable central ply portion, said central ply portion being substantially coextensive with the window, such that the outer portion of the top label ply is outboard of the line of weakness.

20. The label as claimed in claim 1, said bottom label ply including opposite line hole margins, said line hole margins each presenting a series of spaced line holes operable to be engaged by a label feed mechanism.

21. The label as claimed in claim 1; and an adhesive layer applied on at least part of the bottom face of the outer portion of the top label ply, with removal of the border portion exposing the adhesive layer.

22. The label as claimed in claim 21, said top label ply including a central ply portion and a border ply portion that extends at least substantially about the central ply portion, at least part of said border ply portion defining the outer portion of the top label ply.

23. The label as claimed in claim 22, said outer ply edges of the top and bottom label plies being coextensive.

24. The label as claimed in claim 22, said top label ply including an interior line of weakness spaced at least in part from the outer ply edge, with the central ply portion being inboard of the line of weakness and the border ply portion being defined between the outer ply edge and the line of weakness, said central ply portion being substantially coextensive with the window.

25. The label as claimed in claim 21, said adhesive layer covering the bottom face of the top label ply such that at least substantially all of the end section is adhered to the top label ply.

26. The label as claimed in claim 25, said adhesive layer coating the entire bottom face of the top label ply.

* * * * *